US009863612B2

(12) United States Patent
Burt et al.

(10) Patent No.: US 9,863,612 B2
(45) Date of Patent: Jan. 9, 2018

(54) POST CAP ASSEMBLY

(71) Applicant: Fortress Iron, LP, Garland, TX (US)

(72) Inventors: Kevin T. Burt, Dallas, TX (US); Matthew Carlyle Sherstad, Dallas, TX (US); John David Irick, Dallas, TX (US)

(73) Assignee: Fortress Iron, LP, Garland, TX (US)

( * ) Notice: Subject to any disclaimer, the term of this patent is extended or adjusted under 35 U.S.C. 154(b) by 0 days.

(21) Appl. No.: 15/483,726

(22) Filed: Apr. 10, 2017

(65) Prior Publication Data

US 2017/0211785 A1 Jul. 27, 2017

Related U.S. Application Data

(60) Continuation of application No. 14/632,092, filed on Feb. 26, 2015, which is a division of application No.
(Continued)

(51) Int. Cl.
*F21S 8/00* (2006.01)
*F21S 13/10* (2006.01)
(Continued)

(52) U.S. Cl.
CPC ..... *F21V 17/08* (2013.01); *F21S 8/08* (2013.01); *F21V 3/02* (2013.01); *F21V 15/01* (2013.01);
(Continued)

(58) Field of Classification Search
CPC .... E04F 2011/1872; F21S 8/08; F21V 33/006
(Continued)

(56) References Cited

U.S. PATENT DOCUMENTS 3,544,785 A 12/1970 Weibel
3,895,226 A * 7/1975 Murray ..... F21S 8/081 362/367
(Continued)

FOREIGN PATENT DOCUMENTS

KR 20110058943 A 6/2011
RU 2358326 C1 6/2009
RU 85784 U1 8/2009

OTHER PUBLICATIONS

International Search Report for PCT/US2012/069647 dated Mar. 21, 2013 (4 pages).

*Primary Examiner* — Tsion Tumebo
(74) *Attorney, Agent, or Firm* — Gardere Wynne Sewell LLP; Andre M. Szuwalski; John J. "Jake" May

(57) ABSTRACT

A post cap assembly includes a base plate with a floor, an upper peripheral wall extending from the floor in a first direction and a lower peripheral wall extending from the floor in a second direction opposite the first direction. The base plate is configured to be secured to a post having a square-shaped cross section. A cover that has a pyramidal shape is configured to be coupled to the base plate, where the base plate includes at least two tabs that each have a through hole configured to receive a fastener. The base plate includes a plurality of rectangular-shaped through holes extending through the floor of the base plate and disposed proximate the upper peripheral wall of the base plate.

18 Claims, 23 Drawing Sheets

Related U.S. Application Data

13/713,317, filed on Dec. 13, 2012, now Pat. No. 9,109,775.

(60) Provisional application No. 61/576,444, filed on Dec. 16, 2011.

(51) Int. Cl.

| | |
|---|---|
| ***F21V 17/08*** | (2006.01) |
| ***F21V 33/00*** | (2006.01) |
| ***F21V 3/02*** | (2006.01) |
| ***F21V 15/01*** | (2006.01) |
| ***F21V 29/89*** | (2015.01) |
| ***F21V 29/503*** | (2015.01) |
| ***F21S 8/08*** | (2006.01) |
| ***F21V 21/04*** | (2006.01) |
| ***F21V 29/76*** | (2015.01) |
| *F21W 131/10* | (2006.01) |
| *F21Y 115/10* | (2016.01) |
| *F21V 31/00* | (2006.01) |

(52) U.S. Cl.

CPC ..... *F21V 21/04* (2013.01); *F21V 29/503* (2015.01); *F21V 29/763* (2015.01); *F21V 29/89* (2015.01); *F21V 33/006* (2013.01); *F21V 31/005* (2013.01); *F21W 2131/10* (2013.01); *F21Y 2115/10* (2016.08)

(58) Field of Classification Search

USPC ..... 362/431, 153, 153.1, 146, 404, 147, 362/311.01, 311.06, 311.07, 311.09, 362/311.1, 311.14

See application file for complete search history.

(56) References Cited

U.S. PATENT DOCUMENTS 4,035,681 A 7/1977 Savage, Jr.
4,929,942 A * 5/1990 Niimi ..... E01F 9/559 250/215
4,935,665 A 6/1990 Murata
5,075,833 A 12/1991 Dormand
5,156,454 A 10/1992 White
5,607,227 A 3/1997 Yasumoto et al.
5,628,558 A 5/1997 Iacono et al.
6,095,663 A 8/2000 Pond et al.
6,106,134 A 8/2000 Bomas
6,176,595 B1 1/2001 Bomas
6,602,021 B1 * 8/2003 Kim ..... E01F 9/559 116/63 R
6,811,287 B2 11/2004 Roller et al.
6,924,943 B2 8/2005 Minano et al.
7,021,786 B1 4/2006 Sandor, Sr.
7,070,310 B2 7/2006 Pond et al.
7,104,672 B2 9/2006 Zhang
7,143,556 B2 12/2006 Hales
7,278,240 B2 * 10/2007 Burkart ..... B29C 33/005 248/346.01
7,329,024 B2 2/2008 Lynch et al.
7,556,394 B2 7/2009 Patti
7,572,027 B2 8/2009 Zampini, II et al.
7,588,343 B1 * 9/2009 Carter ..... E04C 3/36 362/152
7,607,793 B2 10/2009 Coushaine et al.
7,686,485 B1 * 3/2010 Pever ..... F21V 27/00 362/152
7,703,951 B2 4/2010 Piepgras et al.
8,631,998 B1 * 1/2014 Connelly ..... A47G 29/1216 232/39
8,985,893 B2 * 3/2015 Martin ..... G08B 5/36 340/907
2002/0003697 A1 1/2002 Chien
2002/0024822 A1 2/2002 Pond et al.
2002/0067548 A1 6/2002 TerHovhannisian
2003/0090896 A1 5/2003 Sooferian
2003/0233793 A1 * 12/2003 Burkart ..... B29C 33/005 52/165
2004/0101364 A1 * 5/2004 Kuo ..... E01F 9/553 404/16
2004/0264196 A1 12/2004 Shu
2006/0044806 A1 3/2006 Abramov et al.
2006/0109667 A1 * 5/2006 Flaherty ..... F21S 8/083 362/431
2006/0227535 A1 10/2006 McArthur
2006/0262521 A1 11/2006 Piepgras et al.
2008/0273327 A1 11/2008 Wilcox et al.
2009/0154162 A1 * 6/2009 McCall ..... F21V 33/006 362/249.16
2009/0213583 A1 8/2009 Chang et al.
2010/0284194 A1 11/2010 Miyashita et al.
2011/0075418 A1 3/2011 Mallory et al.
2011/0110077 A1 5/2011 Klus
2012/0120667 A1 5/2012 Schenkl
2013/0114244 A1 * 5/2013 Formico ..... F21V 33/006 362/96
2013/0114251 A1 5/2013 Duan

* cited by examiner

POST CAP ASSEMBLY

CROSS-REFERENCE TO RELATED APPLICATIONS

This application is a continuation of U.S. application for patent Ser. No. 14/632,092, filed on Feb. 26, 2015, now pending, which is a divisional application of and claims priority from U.S. application for patent Ser. No. 13/713,317 filed Dec. 13, 2012, now U.S. Pat. No. 9,109,775, which claims priority from U.S. Provisional Application for Patent Ser. No. 61/576,444 filed Dec. 16, 2011, the disclosures of which are hereby incorporated by reference.

BACKGROUND OF THE INVENTION

Technical Field of the Invention

The present invention relates generally to accent lighting systems and more particularly to accent lights for use in connection with posts, post caps, stairs and vertical, sloped and horizontal surfaces associated, for example, with decks, docks (and other marine applications), patios, arbors and indoor/outdoor spaces.

Description of Related Art

For both safety and aesthetic reasons, there is a desire to provide accent lighting in decks, docks (and other marine applications), patios, arbors and indoor/outdoor spaces. For example, stair installations, such as with the treads or risers, are often lit not only for the obvious safety concerns, but also because such lighting is viewed as attractive and opulent. Similarly, the perimeter of an indoor/outdoor space is often accent lit to provide a clear indication of the barrier location but also to provide pleasing illumination of surfaces without having to use overhead lighting which oftentimes is harsh and overly extensive. Still further, accent lighting is often preferred to overhead lighting because the illumination can be better focused and thus the distracting and perhaps visually interfering overspill associated with overhead lighting sources is avoided. Indeed, accent lighting is preferred in many installations, both indoor and outdoor, because such lighting can effectively address safety concerns while simultaneously providing an attractive lighting feature without concern for light pollution.

A number of accent lighting solutions are known in the art. These solutions suffer from a number of well known drawbacks including excess cost, difficulty or inability for customization, failure of the light source to be hidden from casual view, and premature failure of the lighting sources due to overheating or environmental intrusion (from water, for example).

There is a need in the art address the foregoing and other issues when providing an access lighting system.

SUMMARY

In accordance with an embodiment, an accent lighting source utilizes a light source having a metal heat dissipating housing with an aperture within which at least one point light source, such as from an LED, is mounted. The aperture is closed by a lens/diffuser structure. The light source is mounted within a housing for the accent light source. The housing has a design configuration that supports one or more of a preferred accent lighting installation on a horizontal or vertical surface. Exemplary horizontal surfaces include the top of a post member, a deck surface, a stair surface, an arbor or an overhanging or ceiling surface. Exemplary vertical surfaces include a stair riser and the side of post or wall surface.

In an embodiment, a lighting apparatus comprises: a cylindrical light refracting member having a first end presenting a light emitting surface and a second end; wherein the first end of the cylindrical light refracting member comprises a solid region; wherein the second end of the cylindrical light refracting member comprises a hollow region surrounded by a peripheral side wall; a conical extension projects rearwardly from the solid region into the hollow region; wherein the conical extension includes a central bore; and a lighting source installed within the hollow region and configured to emit light towards the central bore of the conical extension.

In an embodiment, a lighting apparatus comprises: a housing including a front surface member with a rectangular opening; a light refracting member installed with said rectangular opening, said light refracting member including a flat front face mounted substantially flush with the front surface member of the housing; a lighting source installed within the housing and configured to emit light towards the light refracting member, the lighting source including a support body having an aperture within which one or more light emitters are installed and through which emitted light is configured to pass; said light refracting member further including a rear face defined by a convex lens structure which rearwardly extends into said aperture.

In an embodiment, a lighting apparatus comprises: a base plate member including a floor and peripheral side walls, wherein the floor includes a central opening and at least one rectangular peripheral opening adjacent a peripheral side wall, said floor further configured to be mounted to a top surface of a post member; a light refracting member installed with said rectangular opening; a lighting source configured to emit light towards the light refracting member; and a cap member mounted to the base plate member.

In an embodiment, a lighting apparatus comprises: a base plate member including a floor and peripheral side walls, wherein the floor includes a central opening, said floor further configured to be mounted to a top surface of a post member; a glow ring assembly comprising: a light refracting member having a perimeter size and shape generally conforming to a perimeter size and shape of the base plate member; and a lighting source configured to emit light towards the light refracting member; and a cap member mounted to the base plate member with the light refracting member positioned between the cap member and the base plate member.

BRIEF DESCRIPTION OF THE DRAWINGS

A more complete understanding of the method and apparatus of the present invention may be acquired by reference to the following Detailed Description when taken in conjunction with the accompanying Drawings wherein.

DETAILED DESCRIPTION OF THE DRAWINGS

Figure 1A:
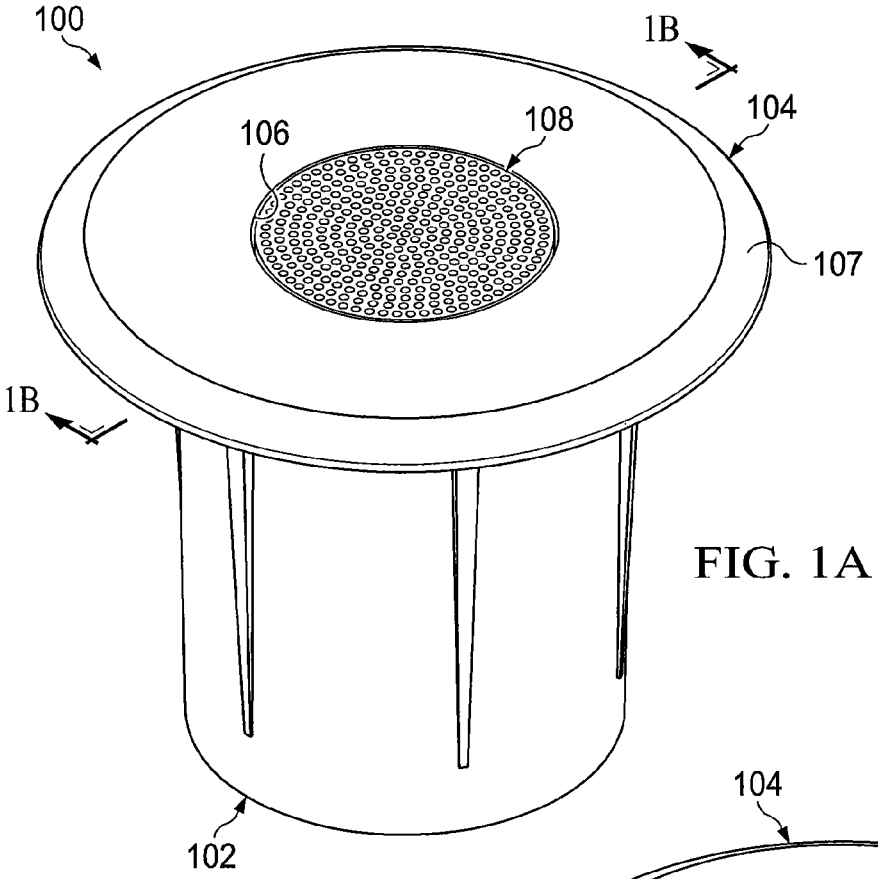
FIG. 1A is a perspective view of a first accent lighting source.
Figure 1B:
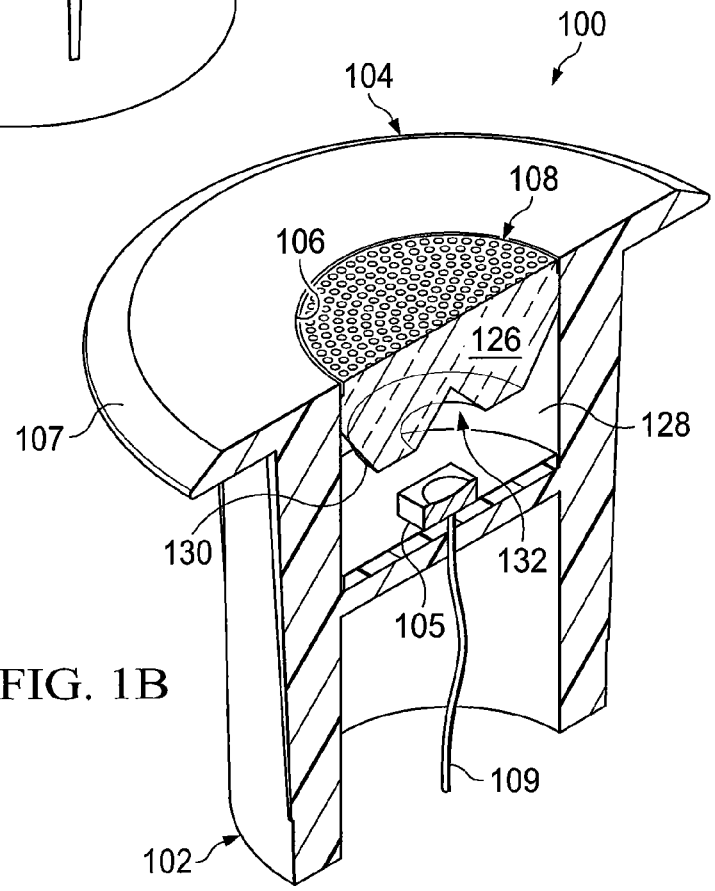
FIG. 1B is a cross-sectional view of the first accent lighting source.

Reference is now made to FIG. 1A which shows a perspective view of a first accent lighting source 100. FIG. 1B shows a cross-sectional view of the source 100. The source 100 is an inset-type source. The source comprises a cylindrical housing 102 terminated at a first end by a cap member 104 in the form of a disc having an opening 106 therein. The diameter of the cap member 104 is greater than the diameter of the cylindrical housing 102. The thickness of the cap member 104 is preferably limited to what is necessary for ensuring proper fabrication and maintaining structural integrity during use. Additionally, a beveled surface 107 is provided at the peripheral edge of the cap member 104. A light source 105 is installed in the cylindrical housing 102. The light source is preferably a light emitting diode type of source sized and shaped to fit within the cylindrical housing 102. The light source will generally comprise a metal housing which functions as a heat dissipater and to which light sources such as light emitting diodes are attached. The metal housing may include a circular aperture in which light sources such as light emitting diodes are installed (see, generally, FIGS. 14 and 15 which illustrate a source of similar type but with a different shape). In a preferred implementation, the accent lighting source 100 further includes a lens or light diffuser 108 that is sized and shaped to conform to the opening 106 (as well as the aperture formed in the metal housing). Preferably, the lens or light diffuser 108 is constructed so that it will present a flush surface mount with respect to a front surface of the cap member 104. The lens or light diffuser 108 may further be sealed with respect to the opening 106 (and the circular aperture) so as to inhibit the ingress of moisture from the front surface of the cap member 104 into the cylindrical housing 102 and light source itself. Electrical leads (wiring) 109 for the light source will extend from a second end of the cylindrical housing 102 opposite the first end.

Figure 2:
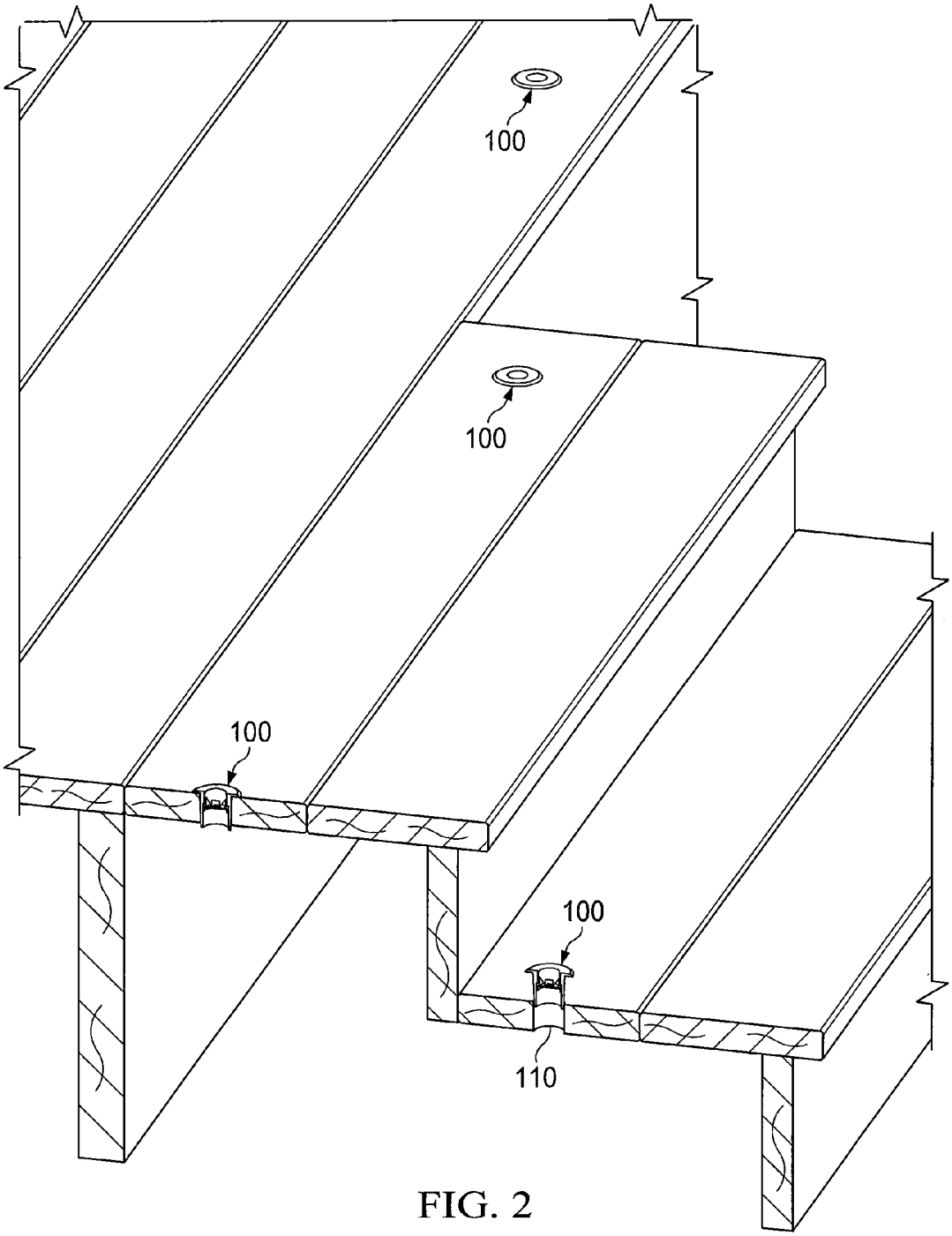
FIG. 2 is a perspective cross-sectional view illustration an application of the first accent lighting source.

Reference is now made to FIG. 2 which shows a perspective cross-sectional view illustrating an application of the first accent lighting source 100. The application concerns accent lighting for a patio deck and stairs. An opening 110 is formed in the deck or stair member (i.e., a desired horizontal (tread) or vertical (riser) surface) at a desired location for accent lighting. The opening 110 is sized to be substantially the same size as the cylindrical housing 102. The first accent lighting source 100 is then press-fit or interference-fit within the opening 110 in a manner whereby the back surface of the cap member 104 is in contact with a surface of the deck or stair member. Additionally, an adhesive material may be used to secure the first accent lighting source 100 within the opening 110. Alternatively, a mechanical retention system (such as a screw or lock ring) may be used from the backside of the deck or stair member to secure the first accent lighting source 100 within the opening 110. Because the thickness of the cap member 104 is minimized, the installed first accent lighting source 100 will effectively provide for a substantially flush mounting to the surface with minimal risk of tripping.

Although not shown in FIG. 2, it will be understood that the first accent lighting source 100 could alternatively be installed in the riser, or other vertical surface, to provide spill light over an adjacent horizontal surface.

Although not shown in FIG. 2, it will be understood that the first accent lighting source 100 could alternatively be installed in the underside of an overhanging vertical surface to provide spill light over an underlying horizontal surface.

The lens or light diffuser 108, as well as the light source itself, may be specifically configured for the application at issue. For example, in the installation shown in FIG. 2, the light source may present a lower light intensity and/or the lens or light diffuser 108 may provide for a wider illumination area. When installed instead on a vertical surface or overhanging horizontal surface, the light source may present a higher light intensity and/or the lens or light diffuser 108 may provide for a directed, narrower or more focused illumination area.

Figure 3A:
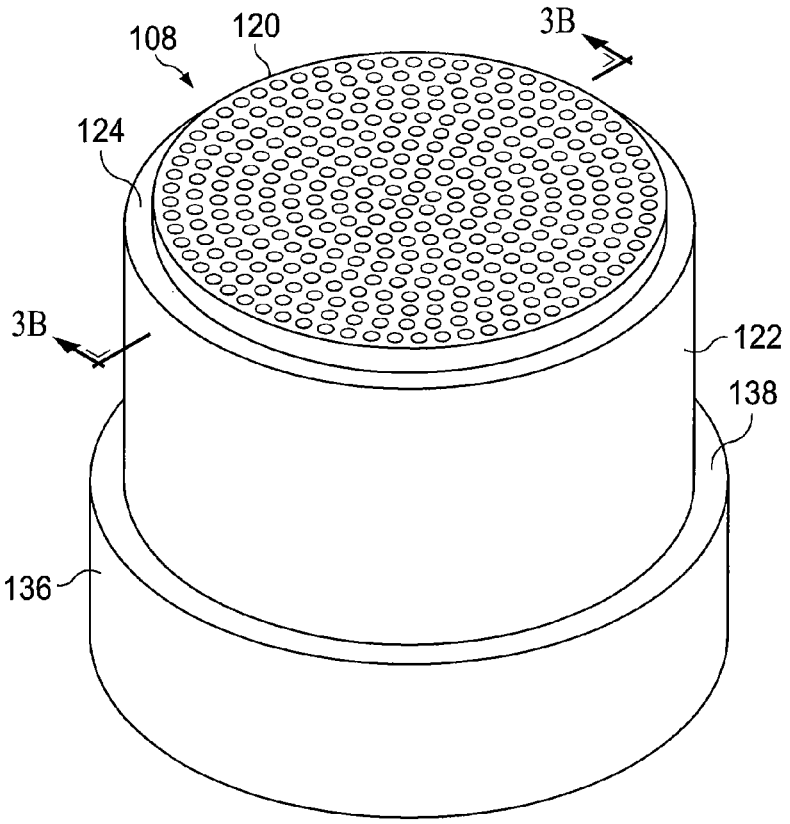
FIG. 3A illustrates a perspective view of a lens used with the first accent lighting source.

Reference is now made to FIG. 3A which illustrates a perspective view of an embodiment for the lens or light diffuser 108 used with the first accent lighting source. An upper surface 120 of the lens 108 is dimpled. The lens 108 has a cylindrical body portion 122. The cylindrical body portion 122 includes a shoulder surface 124 at the periphery of the upper surface 120. The shoulder surface 124 is provided to mate with the opening 106 (FIG. 1). The cylindrical body portion 122 includes a solid upper portion 126 and hollow lower portion 128. Extending from the solid upper portion 126 into the open region defined by the hollow lower portion 128 is a conical portion 130. A central bore 132 is formed within the conical portion 130, and a hollow cylindrical portion 134 extends further from the conical portion 130 concentric with the central bore 132. The hollow lower portion 128 of the cylindrical body portion 122 includes an offset portion 136 defining an outside shoulder 138 and an inside shoulder 140. The offset portion 136 and inside shoulder 140 define an open region 142 below the conical portion 130. It is within this open region 142 that the point light source (shown in phantom) is installed, with the inside shoulder 140 and the inside cylindrical surface of the offset portion 136 providing mounting surface for attaching and positioning the point light source.

Figure 3B:
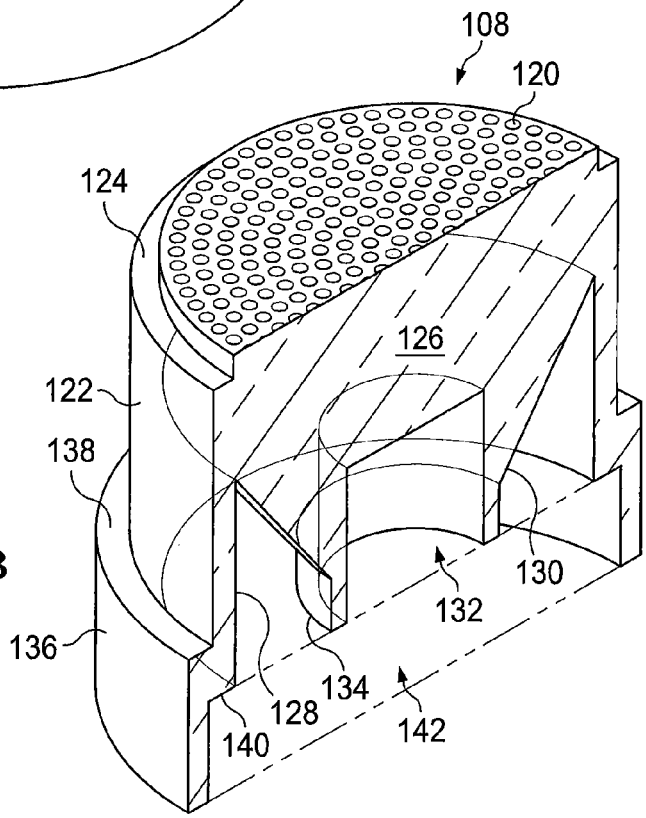
FIG. 3B illustrates a perspective cross-sectional view of the lens shown in FIG. 3A.

The configuration for the lens 108 in FIGS. 3A and 3B is slightly different from that shown in FIG. 1B. Both lens designs share in common the solid upper portion 126, hollow lower portion 128 and conical portion 130. The difference resides with the central bore 132. The central bore 132 in FIG. 3B is cylindrical, while the central bore 132 in FIG. 1B is conical.

Figure 4:
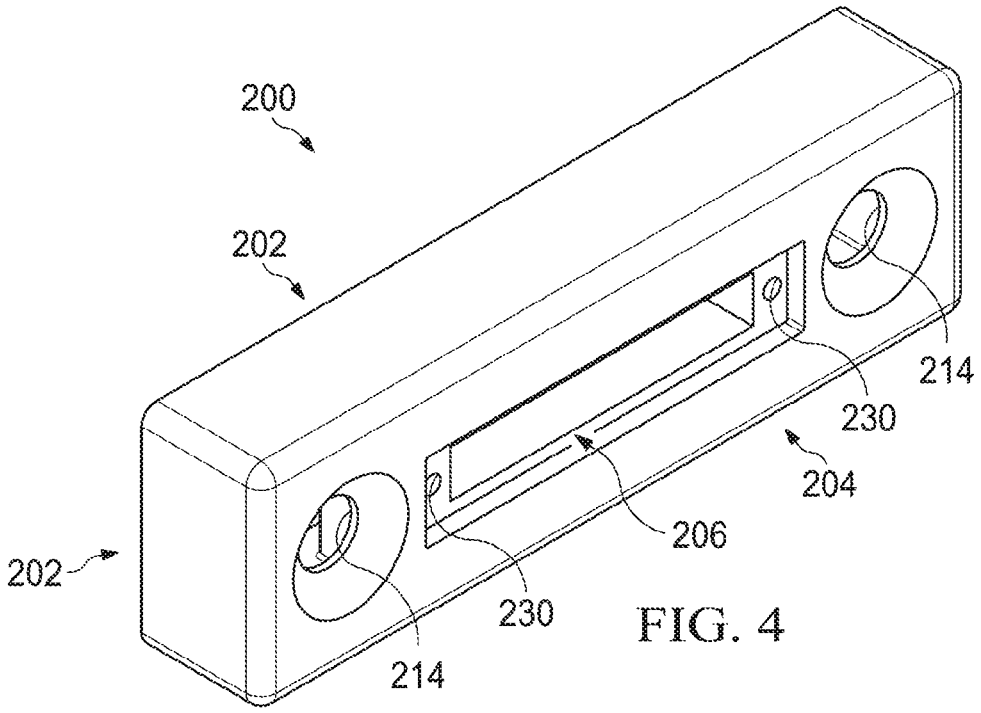
FIGS. 4 and 5 are perspective views of a second accent lighting source.
Figure 5:
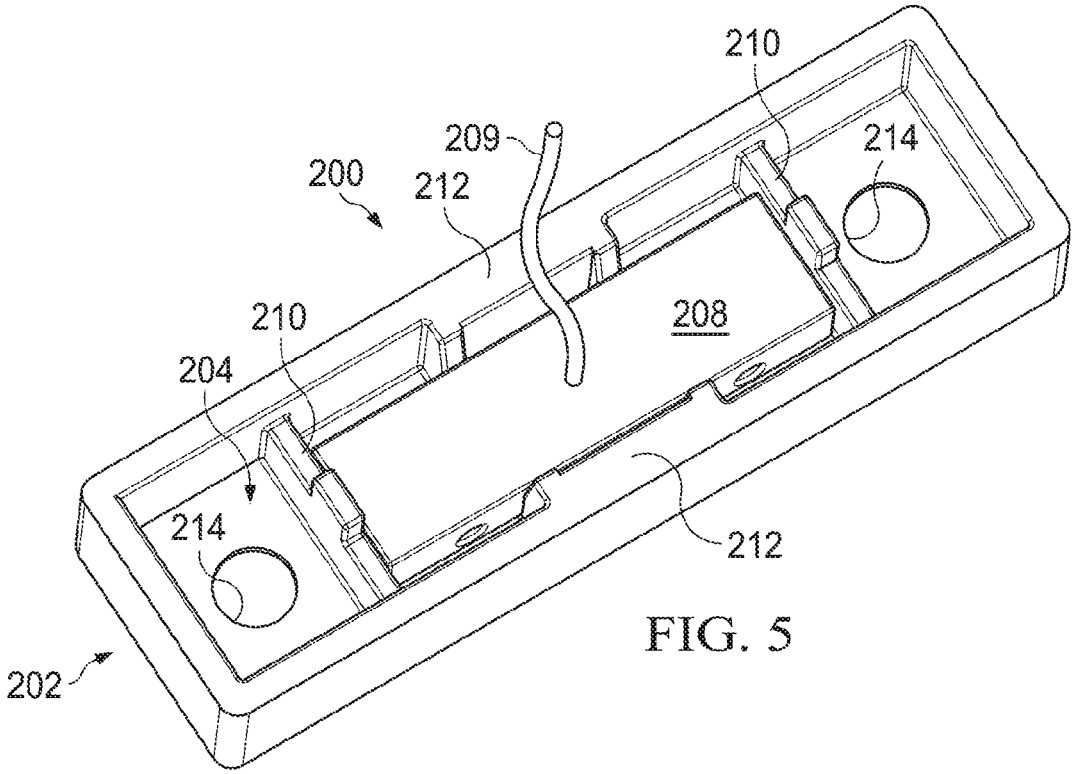

FIGS. 4 and 5 are perspective views of a second accent lighting source 200. Specifically, FIG. 4 shows a view directed towards a front side of the second accent lighting source 200 while FIG. 5 shows a view directed towards a back side of the second accent lighting source 200. The source 200 is a surface mount type source (for installation, for example, to any desired vertical or horizontal surface). The source comprises a box-like housing formed from four side walls 202 and a front rectangular member 204. A rectangular opening 206 is formed in the front rectangular member 204. A light source 208 is installed in the housing and is aligned with opening 206 using alignment walls 210 (extending between the two longer side walls on either end of the opening 206) and alignment buffers 212 positioned on the two longer side walls on either side of the opening 206). The light source is preferably a light emitting diode type of source sized and shaped to fit within the box-like housing. The light source will generally comprise a metal housing which functions as a heat dissipater and includes an aperture in which light sources such as light emitting diodes are installed (see, generally, FIGS. 14 and 15 which illustrate a source of similar type). Electrical leads (wiring) 209 for the light source will extend from a back side of the housing.

Figure 6A:
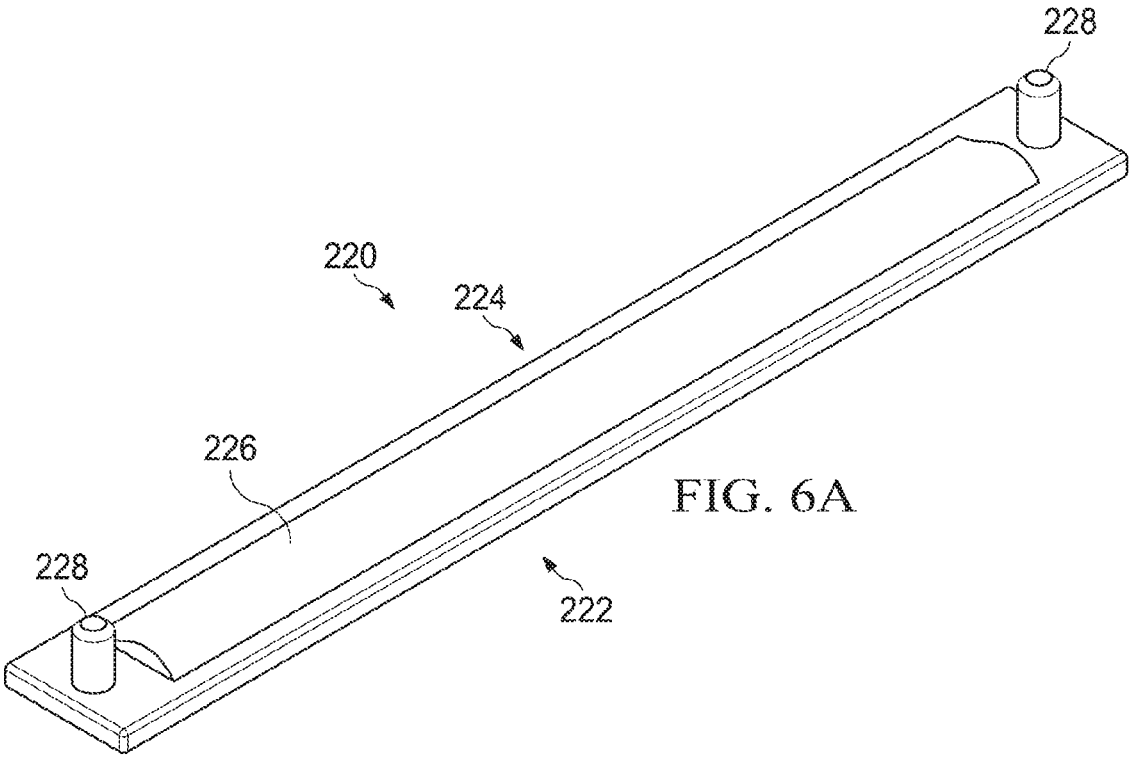
FIGS. 6A-6B illustrate various views of a lens used with the second accent lighting source (as well as with the third light accent lighting source discussed below)
Figure 6B:
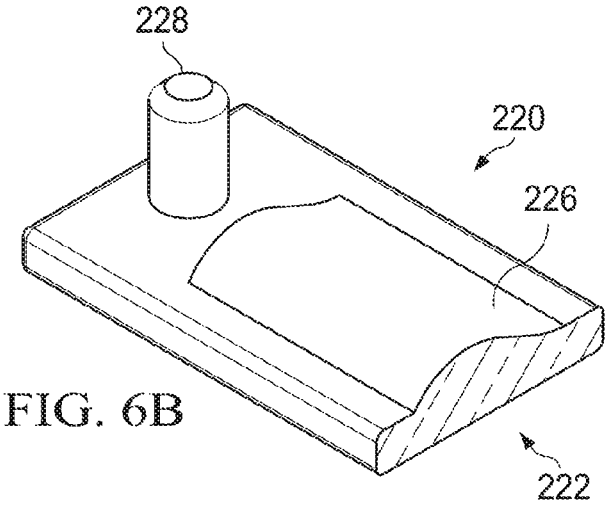

In a preferred implementation the light source further includes a lens or light diffuser 220 (see FIGS. 6A-6B) that is sized and shaped to conform to the opening 206. FIG. 6B shows a lateral perspective cross-section of the lens or light diffuser 220 shown in FIG. 6A. Preferably, the lens or light diffuser 220 is constructed so that a front side 222 will present a flush surface mount with respect to a front surface of the front rectangular member 204. A back side 224 of the lens or light diffuser 220 is provided with a straight longitudinally extending convex surface 226 (which is received within the aperture of the light source housing). The convex surface is shaped to assist in directing the light from the light source 208 as needed and with a desired pattern or spread. In an embodiment, the straight longitudinally extending convex surface is laterally offset from a longitudinal center of the convex lens structure light refracting member in order to provide directed light projection. Additionally, in an embodiment, the lateral cross-sectional shape of the convex surface is not symmetric. The back side 224 of the lens or light diffuser 220 further includes a pair of installation pins 228 which fit within a corresponding pair of installation openings 230 (see, FIG. 4) formed in the light source 208.

The lens or light diffuser may further be sealed with respect to the opening 206 and the aperture in the housing so as to inhibit the ingress of moisture to within the housing and light source.

The front rectangular member 204 of the housing further includes two countersunk installation openings 214 configured to receive mounting screws.

Figure 7:
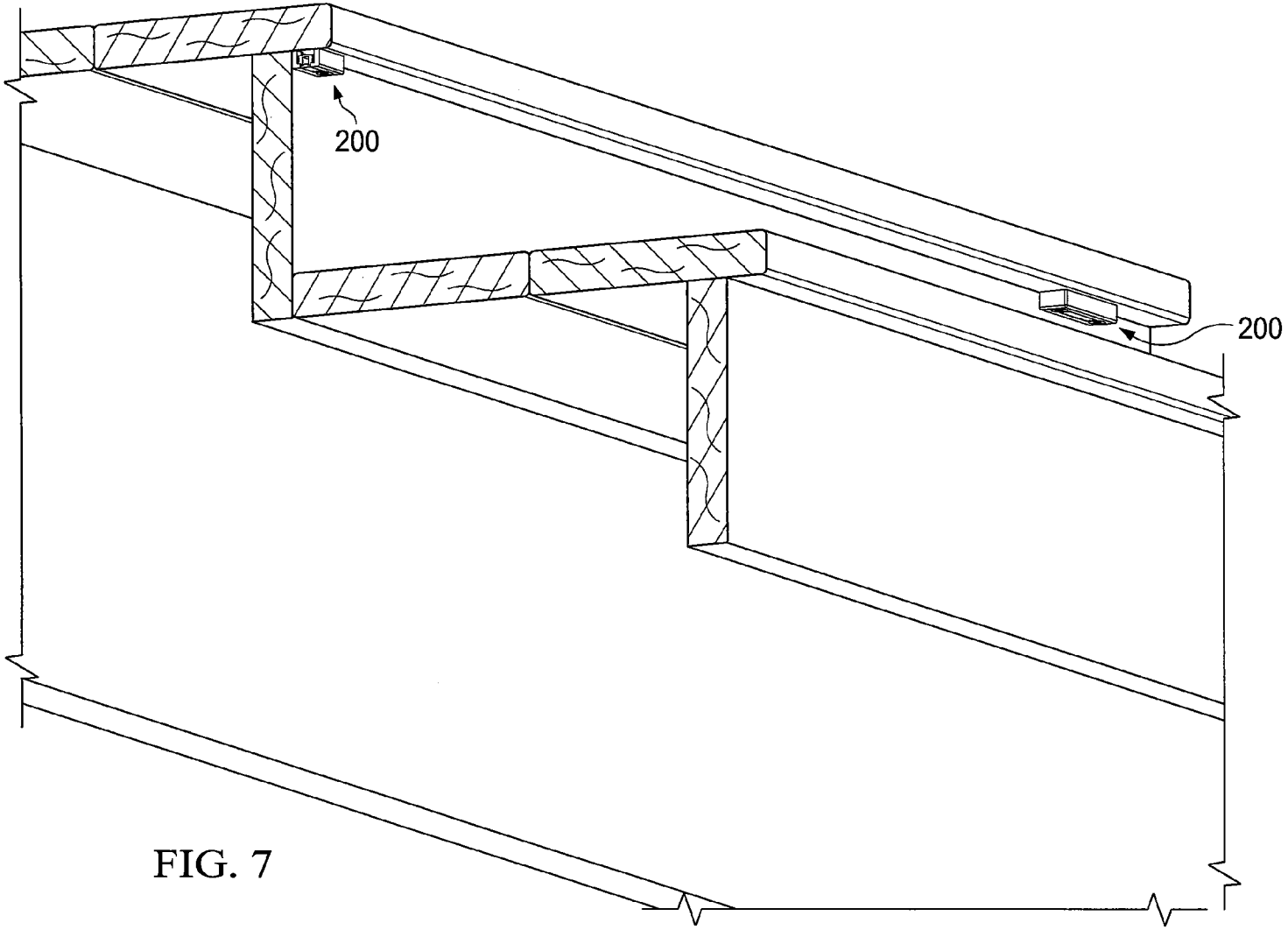
FIG. 7 is a perspective cross-sectional view illustration an application of the second accent lighting source.

Reference is now made to FIG. 7 which shows a perspective cross-sectional view illustrating an application of the second accent lighting source 200. The application concerns accent lighting for a patio stair (or other horizontal surface). The stair tread member overhangs the riser member by a distance. The second accent lighting source 200 is installed on an underside surface of the stair tread member which is exposed beyond the riser member. Installation screws are inserted through the openings 214 so as to mount the housing of the second accent lighting source 200 to the underside of the stair tread. A slot may be provide in the underside surface of the stair tread to permit routing of the wire leads for the light source to a location behind the riser member. Care is taken in orienting the second accent lighting source 200 at installation such that the generated light is properly directed. For example, to spill on both the riser member and the underlying stair tread, or alternatively to spill primarily on the underlying stair tread.

Figure 8:
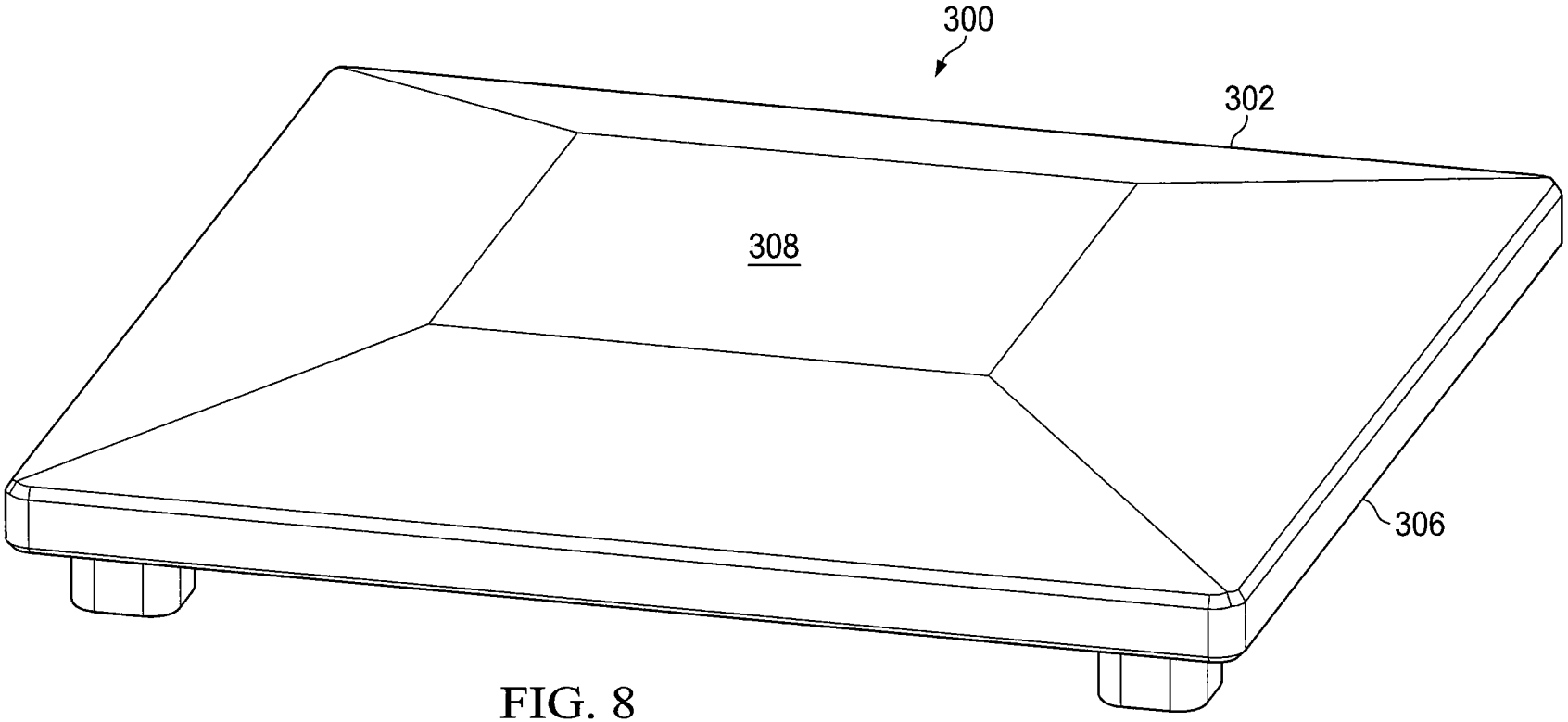
FIGS. 8, 9, and 10 are perspective views of a third accent lighting source FIG. 8.
Figure 9:
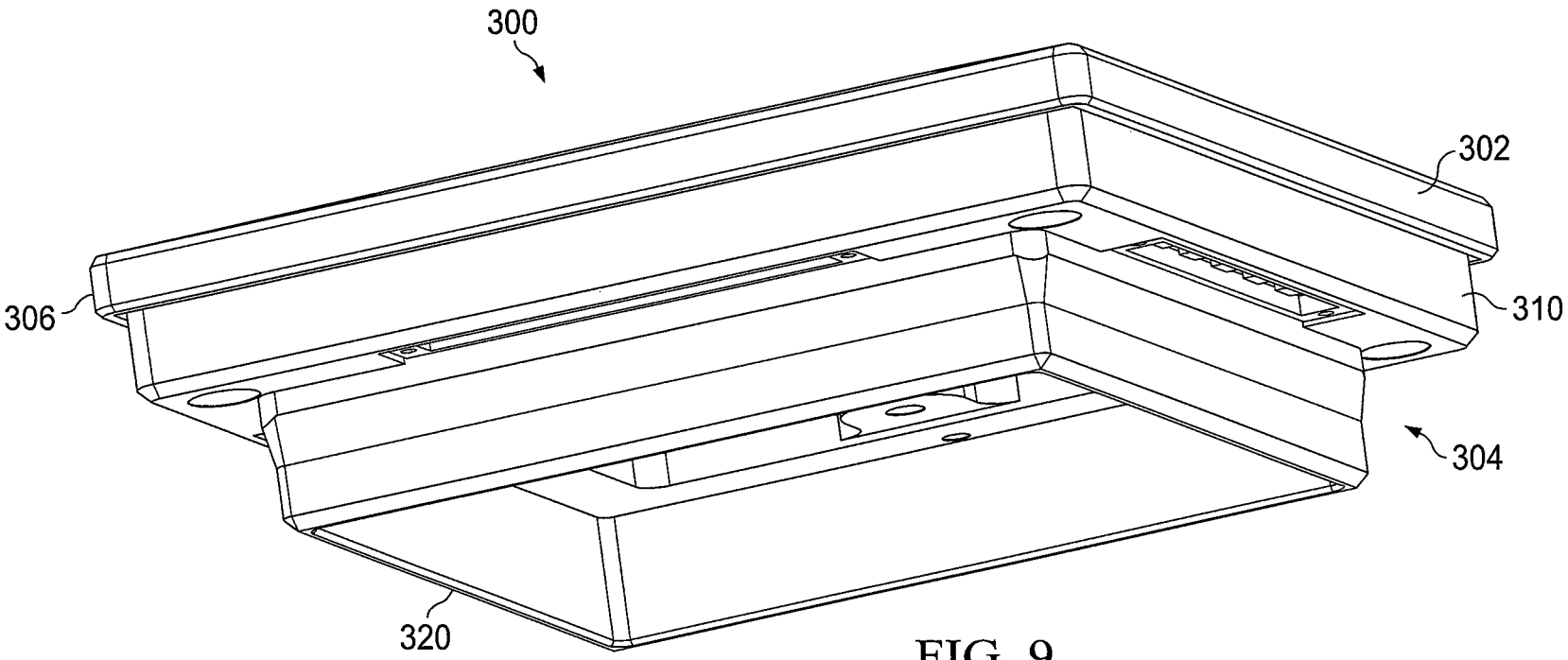
Figure 10:
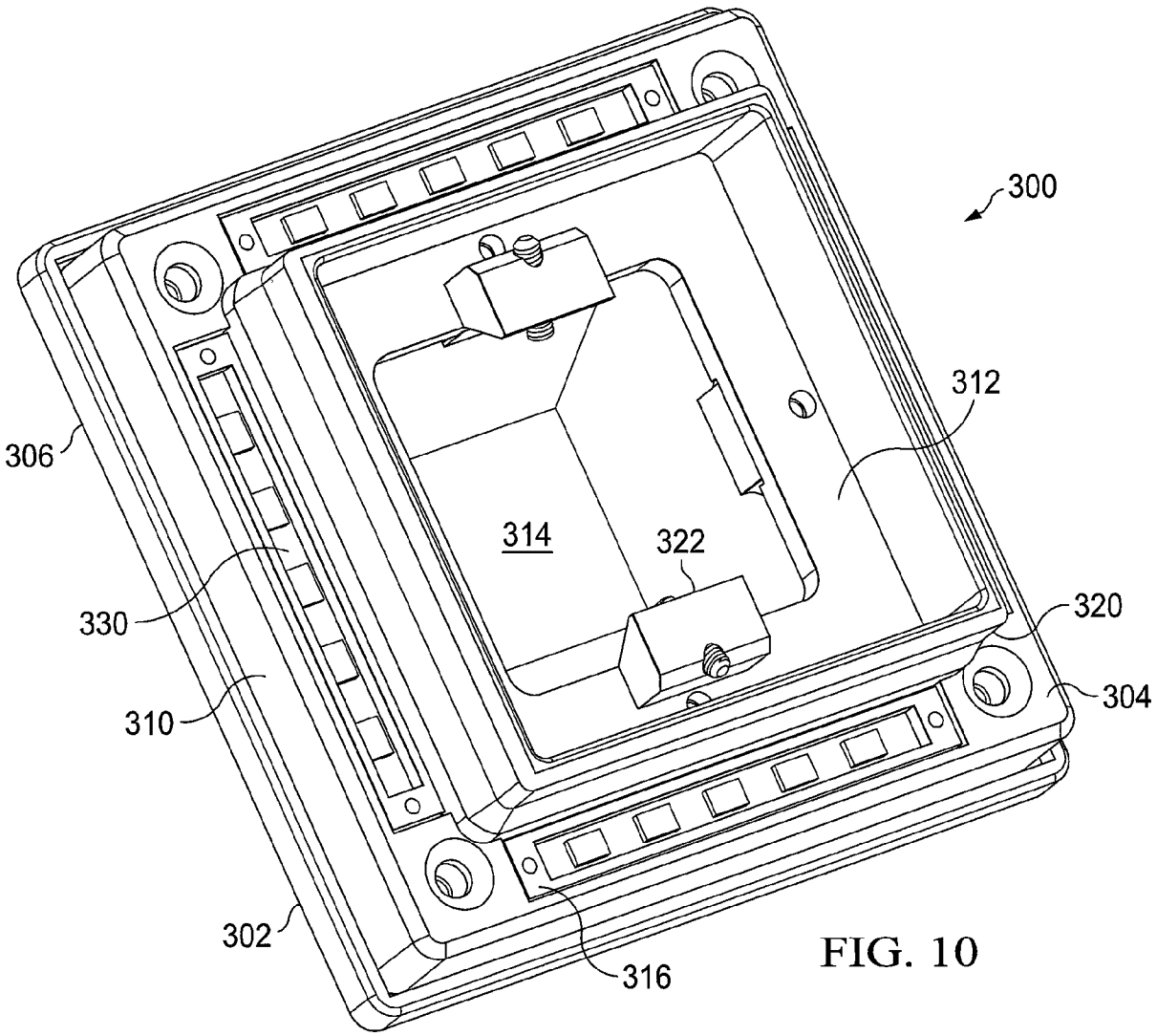
Figure 11:
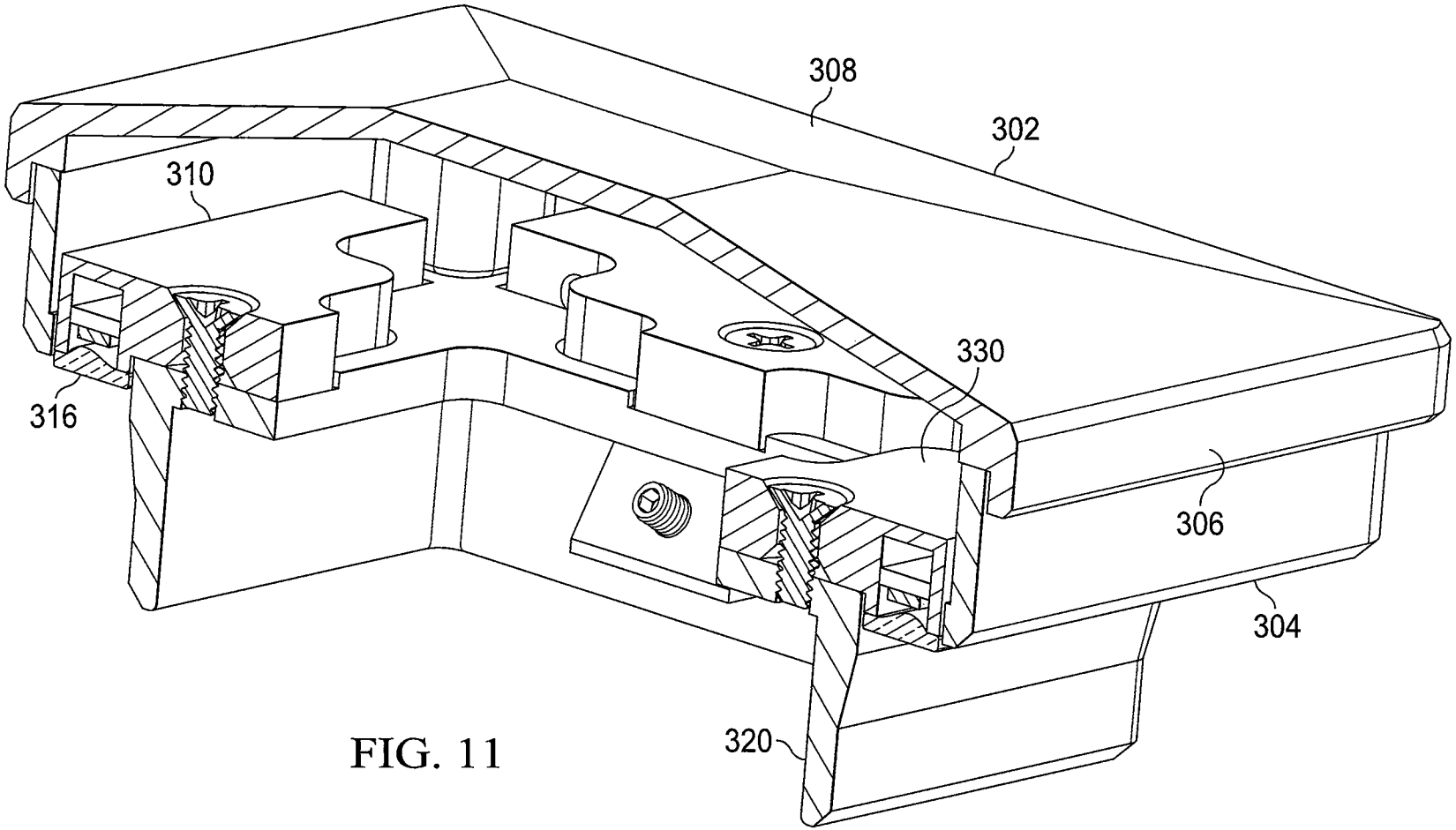
FIG. 11 is a cross-sectional perspective view of the third accent lighting source.

FIGS. 8, 9 and 10 are perspective views of a third accent lighting source 300. Specifically, FIG. 8 shows a view directed towards a top side of the third accent lighting source 300, FIG. 9 shows a view directed towards a side of the third accent lighting source 300, and FIG. 10 shows a view directed towards a back side of the third accent lighting source 300. FIG. 11 is a cross-sectional perspective view of the third accent lighting source.

Figure 12:
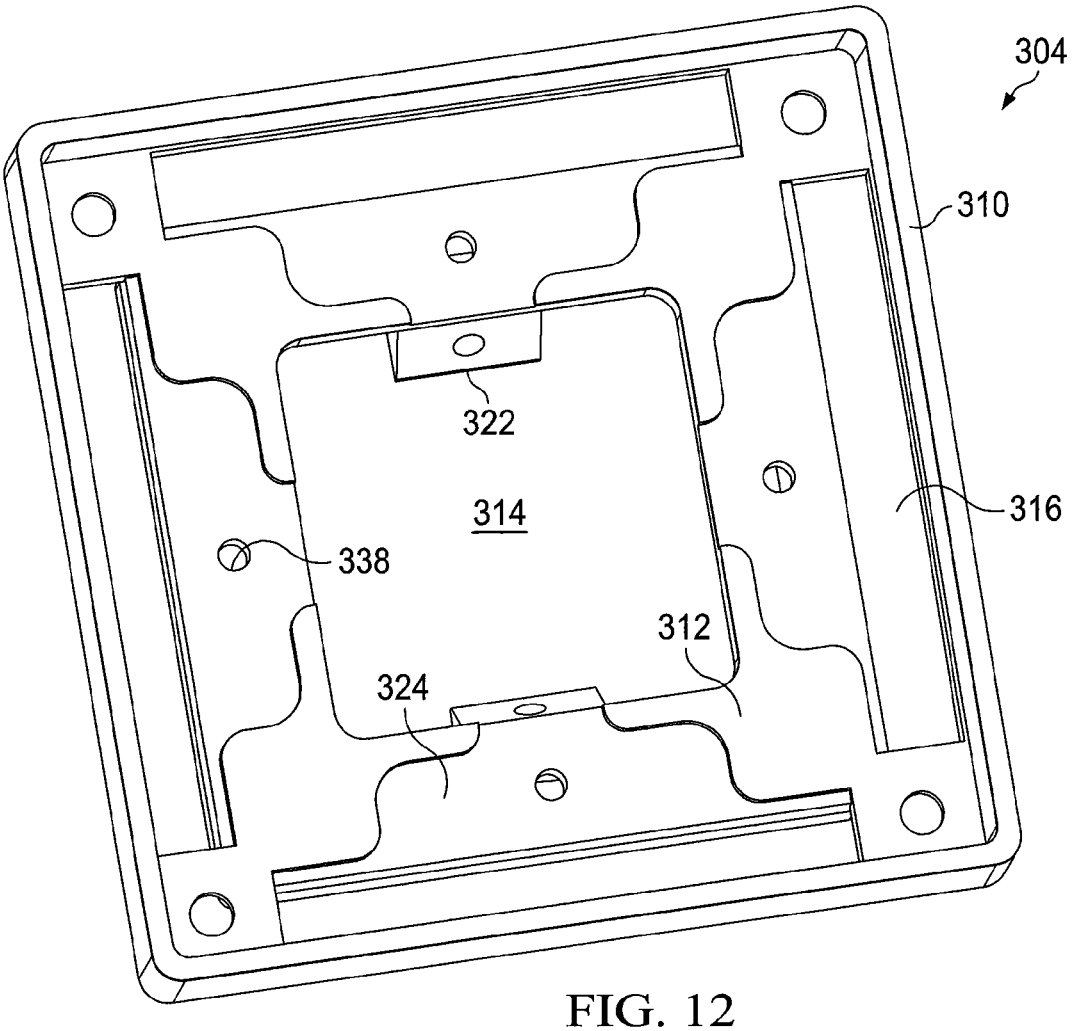
FIGS. 12 and 13 show perspective view of two embodiments for a base plate, for exemplary use with two different types of posts: wood and hollow (metal)
Figure 13:
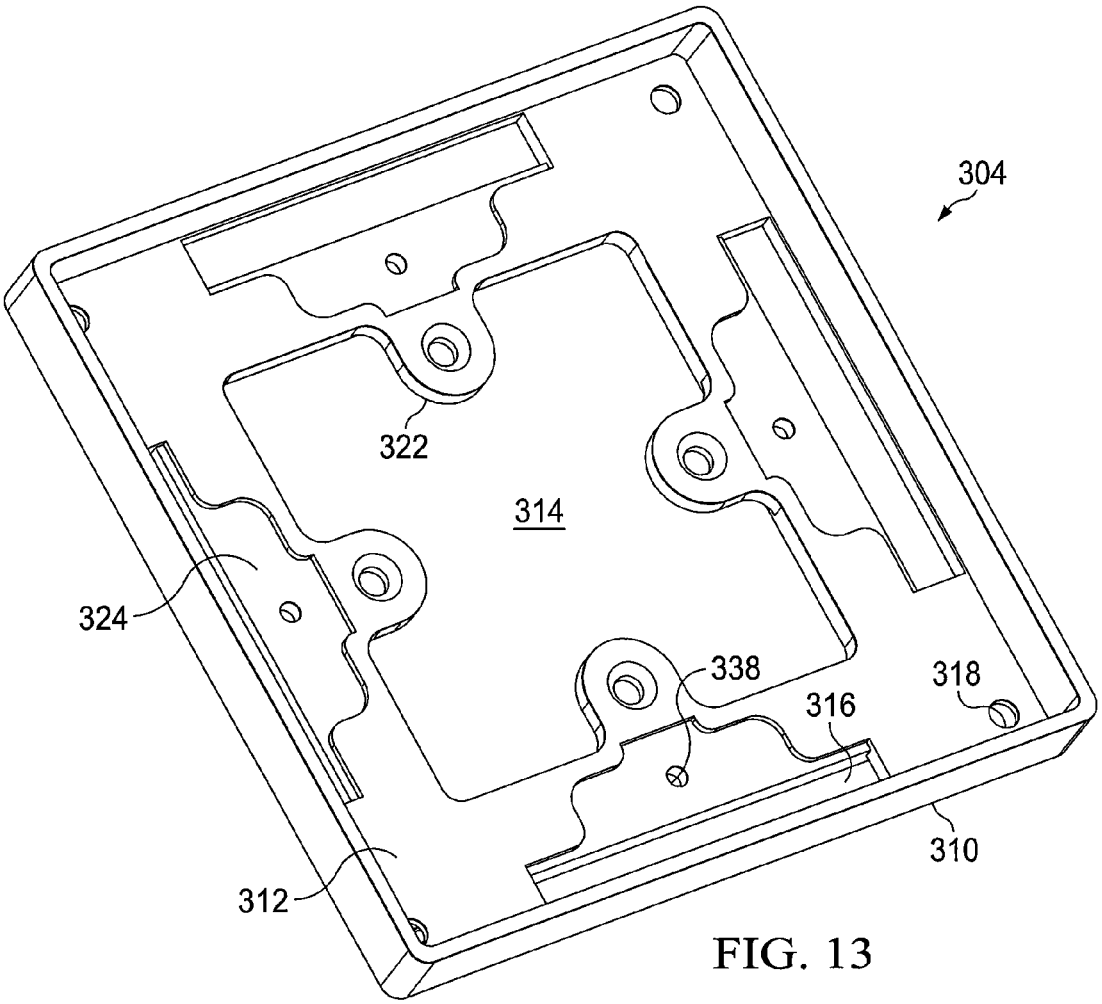

The source 300 is a post cap mount type source designed for installation at the top of a post member. The source comprises a cover 302. The cover includes side walls 306 and a roof 308, with the roof 308 having a truncated pyramidal shape. The truncated pyramidal shape for cover 302 is an aesthetic choice, it being understood that the cover 302 may have any desired external configuration (including pyramidal, domed, flat, and the like). The source further comprises a base plate 304. Perspective views of two embodiments for the base plate 304 are shown in FIGS. 12 and 13. The base plate 304 includes first side walls 310 and a floor 312 wherein the side walls 310 extend perpendicularly from an outer peripheral edge of the floor 312. The walls 310 of the floor 312 are configured to fit within the walls 306 of the cover 302. The floor 312 includes a central opening 314. The floor 312 further includes a plurality of rectangular light openings 316 positioned adjacent the side edges of the floor 312. The floor 312 further includes a mounting opening 318 at each corner of the outer peripheral edge of the floor 312. When the cover 302 is installed on the base plate 304, mounting hardware, such as screws, can extend through the mounting openings 318 so as to permit the cover 302 to be secured to the base plate 304. Advantageously, this mounting hardware is hidden from normal viewing of the third accent lighting source 300. The base plate 304 further includes second side walls 320, wherein the side walls 320 extend perpendicularly from the floor 312 in a direction opposite that of the first side walls 310. The walls 320 of the floor 312 are configured to fit over a wood or hollow metal post member to which the third accent lighting source 300 is installed. Tab 322 with an opening is provided in association with the floor 312 to assist in attaching the base plate 304 to the post member. When the base plate 304 is installed on post member, mounting hardware, such as screws, can extend through the opening in each tab 322 so as to permit the base plate 304 to be secured in place at the top of the post member. FIG. 12 illustrates the configuration of base plate 304 for use with a hollow metal post, the tab 322 comprising a boss member with an angled surface and angled opening through which the mounting hardware extends for attachment to an inside surface of the hollow post (see, also, FIG. 10). Conversely, FIG. 13 illustrates the configuration of base plate 304 for use with a wood post, the tab 322 comprising a flat surface and opening through which the mounting hardware extends for attachment to a top surface of the wood post. Advantageously, this mounting hardware is hidden from normal viewing of the third accent lighting source 300.

Associated with each rectangular light opening 316 is a recessed surface feature 324. The recessed surface feature 324 provides an alignment guide assisting with the installation of a light source 330 (FIGS. 14 and 15) at any of all of the rectangular light openings 316. The light source 330 comprises a metal housing 332 having a slot 334 within which point light sources 330' such as light emitting diodes are installed. The metal housing not only supports the point light sources, but also functions as a heat dissipater. A mounting opening 336 is provided in the metal housing 332. The opening 336 aligns with a corresponding opening 338 formed in the recessed surface feature 324. Mounting hardware, such as a screw, can be used to secure metal housing 332 to the base plate 304 using openings 336 and 338. Advantageously, this mounting hardware is hidden from normal viewing of the third accent lighting source 300.

Figure 16:
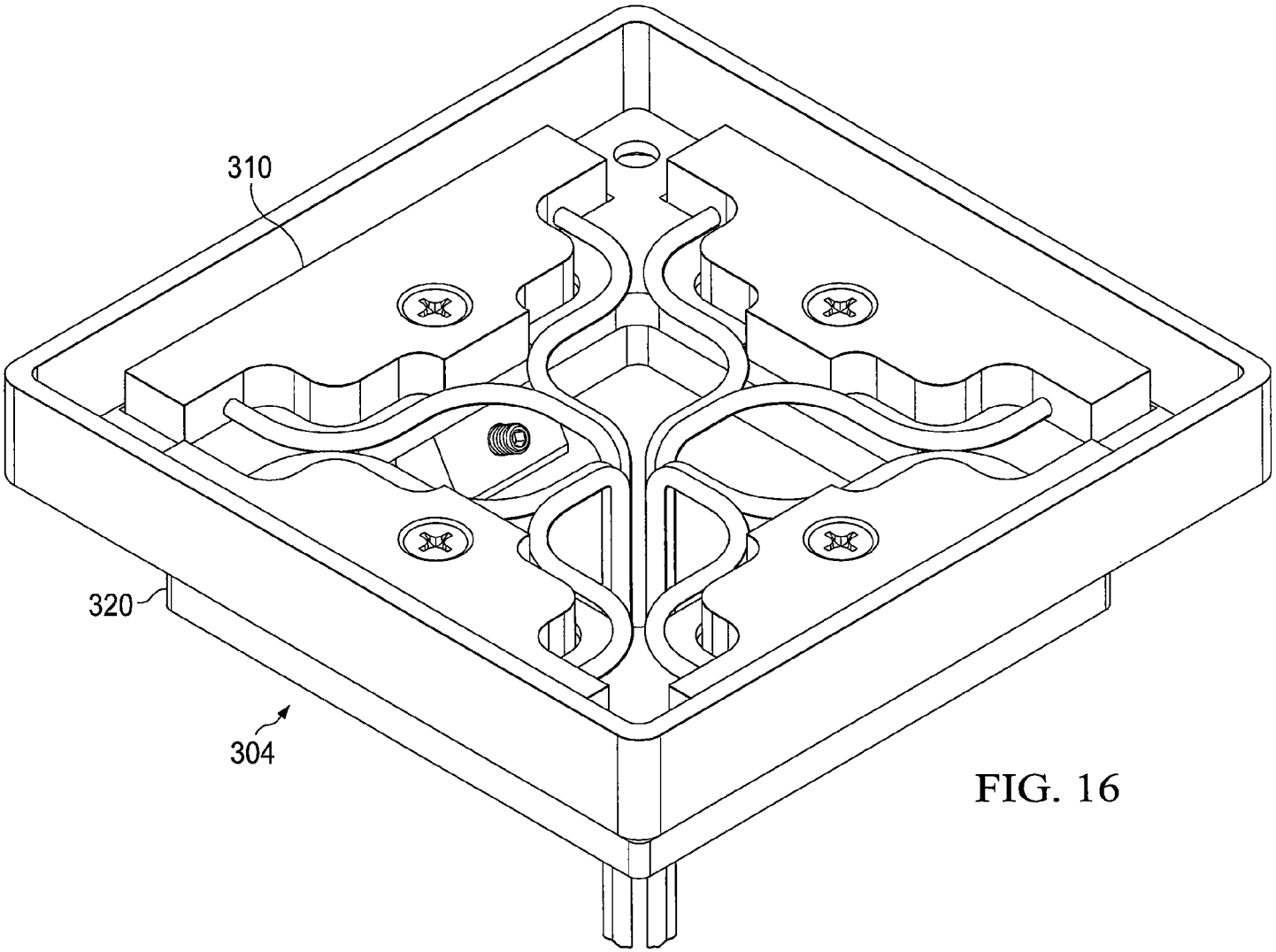
FIGS. 16 and 17 illustrate attachment of light sources to the base plate for the third accent lighting source.
Figure 17:
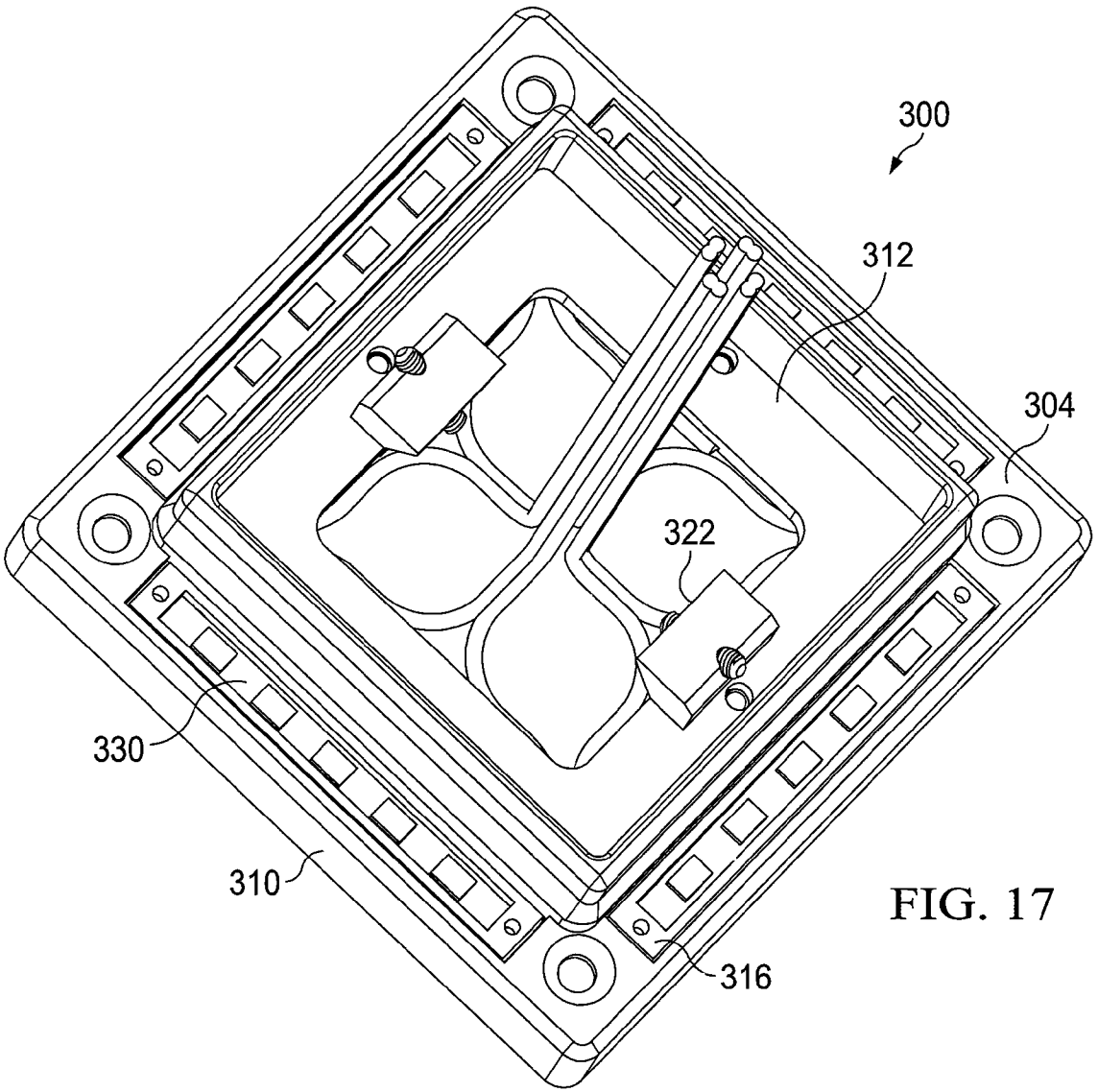

Attachment of light sources 330 to the base plate 304 is shown in FIGS. 16 and 17. Specifically, FIG. 16 shows a top perspective view of the light sources 330 attached to the base plate 304, while FIG. 17 shows a bottom perspective view of the light sources 330 attached to the base plate 304. Although FIGS. 16 and 17 show attachment of a light source 330 at each rectangular light opening 316, it will be recognized that the number of included light sources 330 is selectable. Certain installations may require accent lighting on fewer than all sides of the post member. In such situations, the installer may select and install the desired number of light sources 330.

A preferred implementation the light source 330 further includes a lens or light diffuser 220 (see FIGS. 6A-6B described above) that is sized and shaped to conform to the rectangular light opening 316 and slot 334. Preferably, the lens or light diffuser 220 is constructed so that a front side 222 will present a flush surface mount with respect to a bottom surface of the base plate 304. A back side 224 of the lens or light diffuser 220 is provided with a convex surface 226. The convex surface is shaped to assist in directing the light from the light source 208 as needed and with a desired pattern or spread. The back side 224 of the lens or light diffuser 220 further includes a pair of installation pins 228 which fit within a corresponding pair of installation openings 230 formed in the light source 330.

The lens or light diffuser may further be sealed with respect to the rectangular light opening 316 and slot 334 so as to inhibit the ingress of moisture to within the housing 332.

Figure 18:
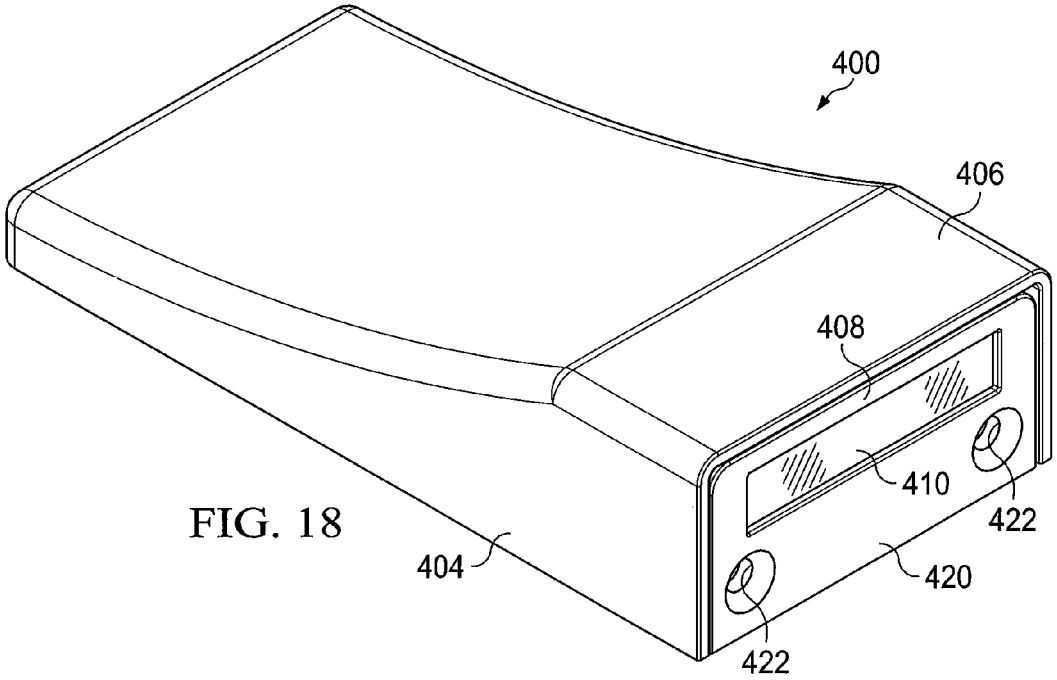
FIGS. 18 and 19 are perspective views of a fourth accent lighting source.
Figure 19:
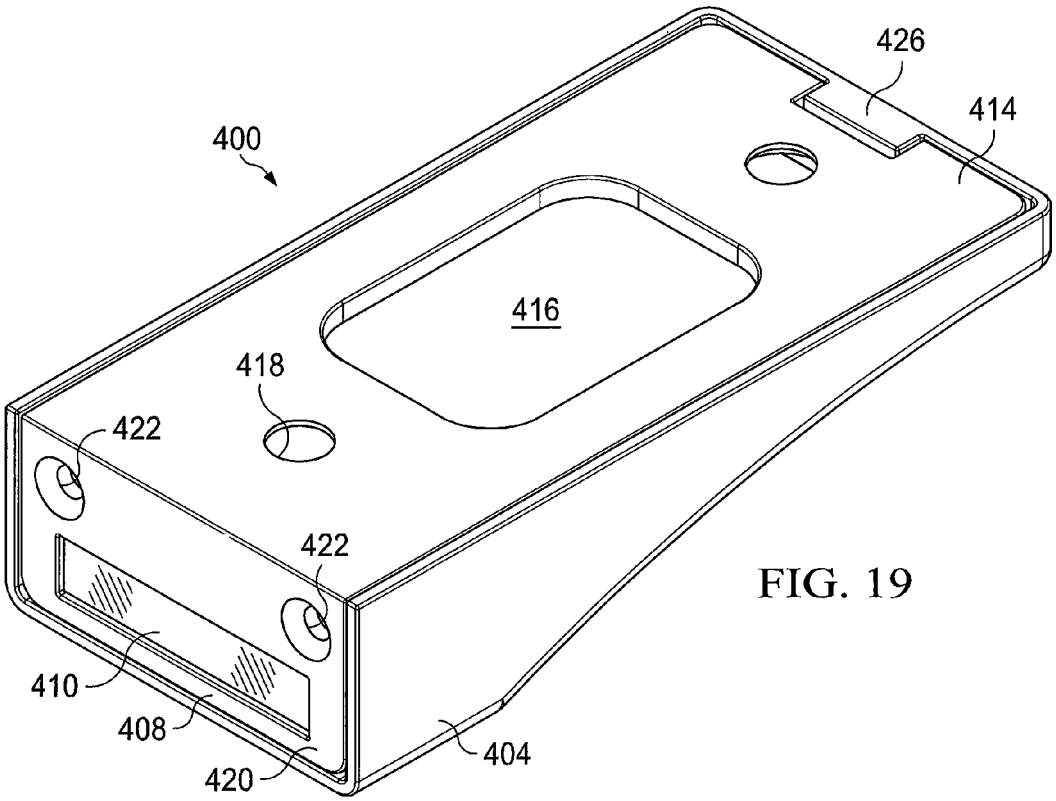
Figure 20:
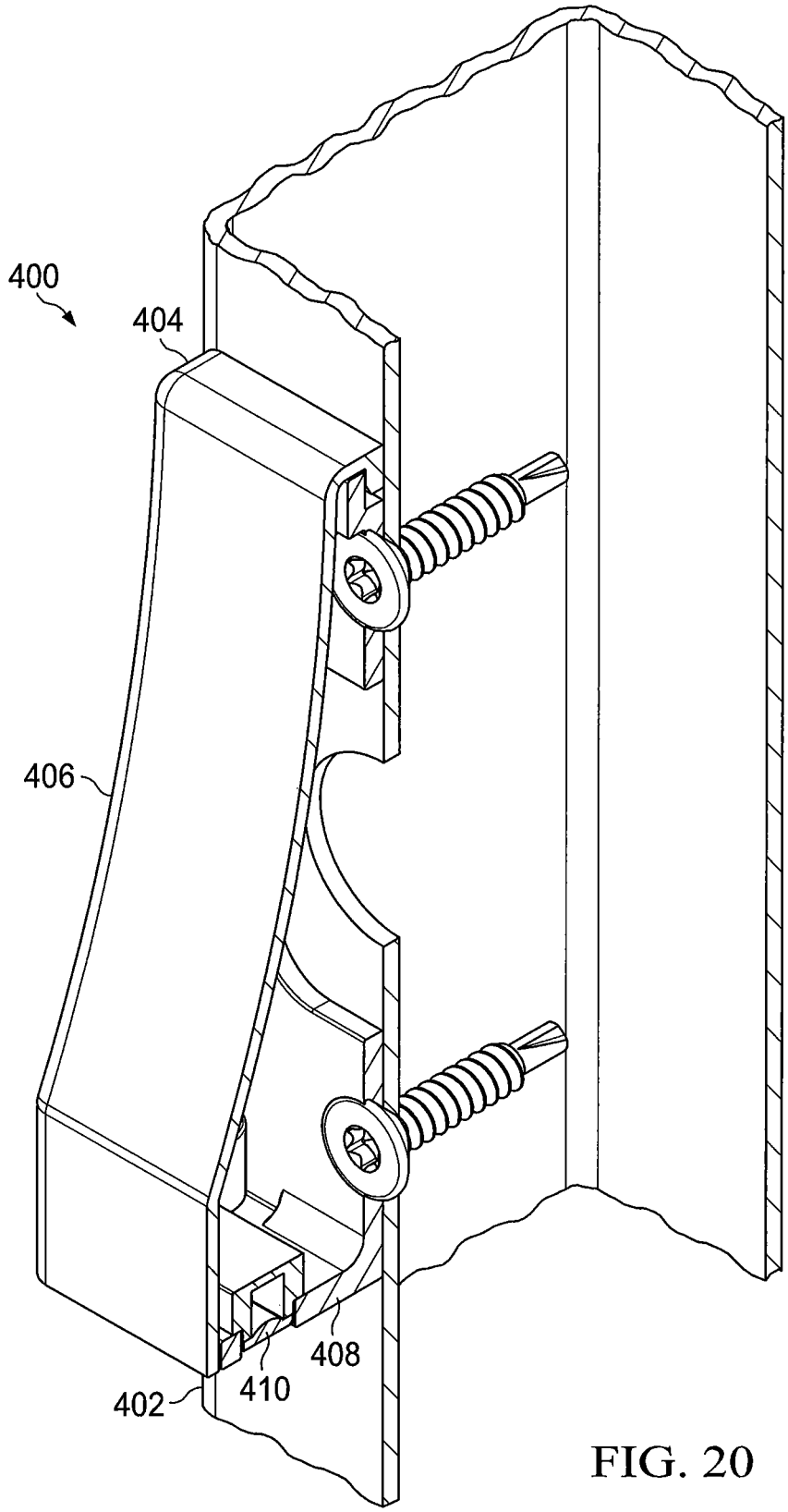
FIG. 20 is a cross-sectional perspective view showing attachment of the fourth accent lighting source to a vertical surface.

FIGS. 18 and 19 are perspective views of a fourth accent lighting source 400. Specifically, FIG. 18 shows a view directed towards a front side of the fourth accent lighting source 400 while FIG. 19 shows a view directed towards a back side of the fourth accent lighting source 400. FIG. 20 is a cross-sectional perspective view of the fourth accent lighting source installed on a vertical surface 402 (such as provided by a post member).

Figure 14:
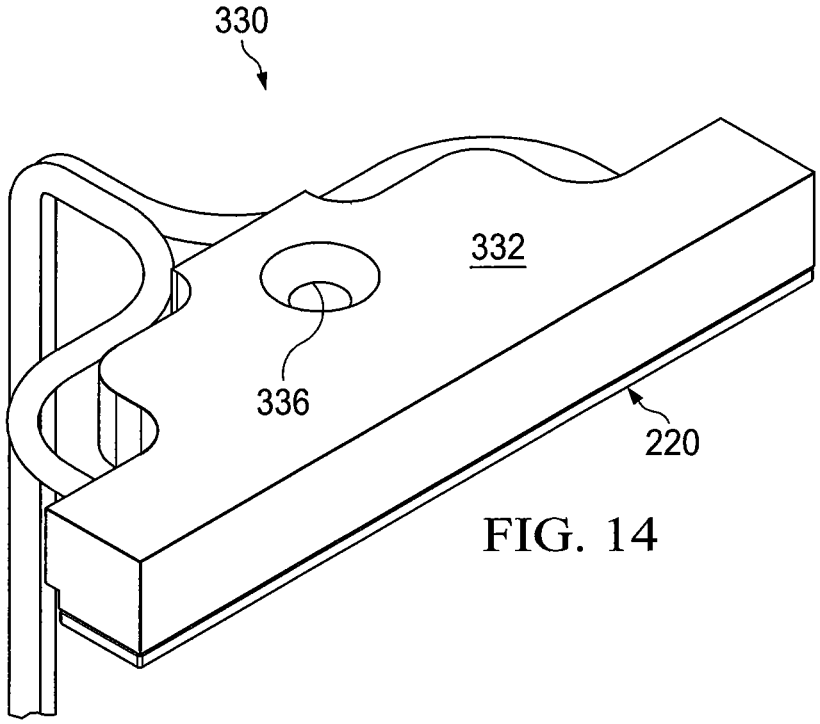
FIGS. 14 and 15 show perspective view of a light source for the third accent lighting source.
Figure 15:
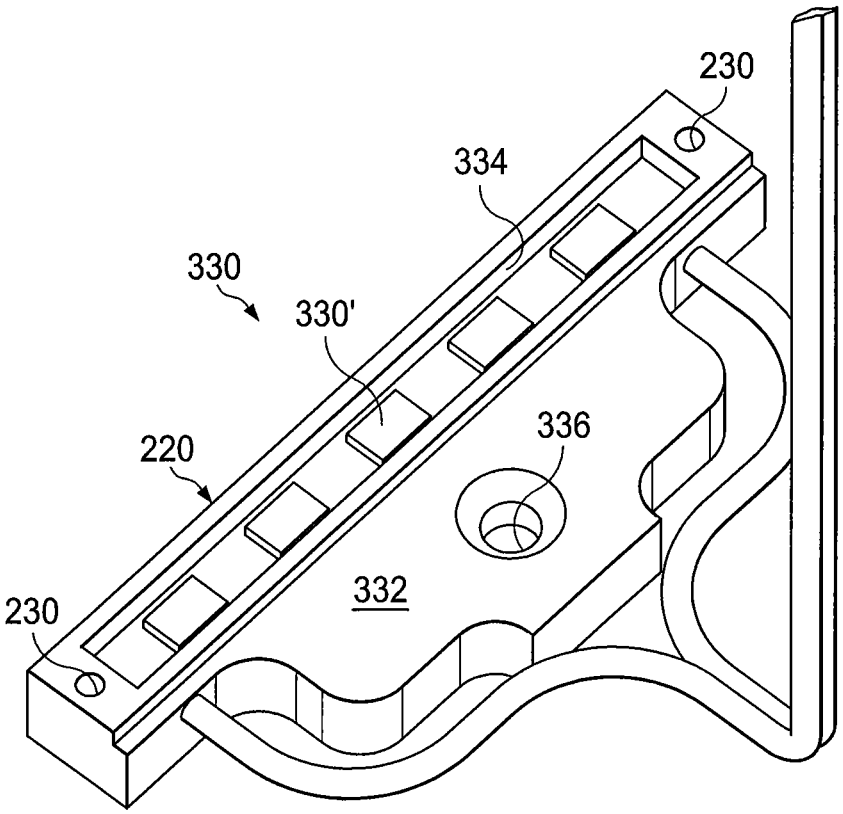

The source 400 is a surface mount type source. The source comprises a housing formed from three side walls 404 and a roof 406. It will be noted that the roof 406 presents a sloping surface. The shortest end of the housing is a top of the source 400, while the tallest end of the housing is a bottom of the source 400 (see, FIG. 20). The source 400 further comprises a mounting plate 414. The mounting plate 414 is sized and shaped to be received within the side walls 404 of the housing. The mounting plate 414 includes a central opening 416 and two mounting openings 418. The opening 416 provides path through which wiring for the source 400 may pass. Mounting hardware, such as a screw, can be used to secure mounting plate 414 to the vertical surface 402 using openings 418. Advantageously, this mounting hardware is hidden from normal viewing of the fourth accent lighting source 400. At the tallest end of the housing, the mounting plate 414 includes a perpendicular portion 420 that defines a fourth side wall of the source. A rectangular opening 408 is formed in the perpendicular portion 420. A light source 410 is installed in the housing and is aligned with opening 408. The light source is preferably a light emitting diode type of source (of the type and configuration described herein, for example, as is shown in FIGS. 14 and 15). The perpendicular portion 420 further includes two mounting openings 422. Mounting hardware, such as a screw, can be used to secure mounting plate 414 to the housing side walls using openings 422. Advantageously, this mounting hardware is hidden from normal viewing of the fourth accent lighting source 400. The side wall at the shortest end of the housing includes a tab member 426 which engages the top end of the mounting plate 414 and assists in retaining the mounting plate within the housing.

In a preferred implementation the light source further includes a lens or light diffuser 220 (see FIGS. 6A-6B, described above) that is sized and shaped to conform to the opening 408. Preferably, the lens or light diffuser 220 is constructed so that a front side 222 will present a flush surface mount with respect to perpendicular portion 420. A back side 224 of the lens or light diffuser 220 is provided with a convex surface 226. The convex surface is shaped to assist in directing the light from the light source 208 as needed and with a desired pattern or spread. The back side 224 of the lens or light diffuser 220 further includes a pair of installation pins 228 which fit within a corresponding pair of installation openings (not shown here, see for example FIGS. 4 and 15) formed in the light source 208.

The lens or light diffuser may further be sealed with respect to the rectangular opening 408 (and slot 334) so as to inhibit the ingress of moisture to within the housing. Electrical leads for the light source will extend out the back side of the source through the opening 416 in the mounting plate 414.

Figure 21:
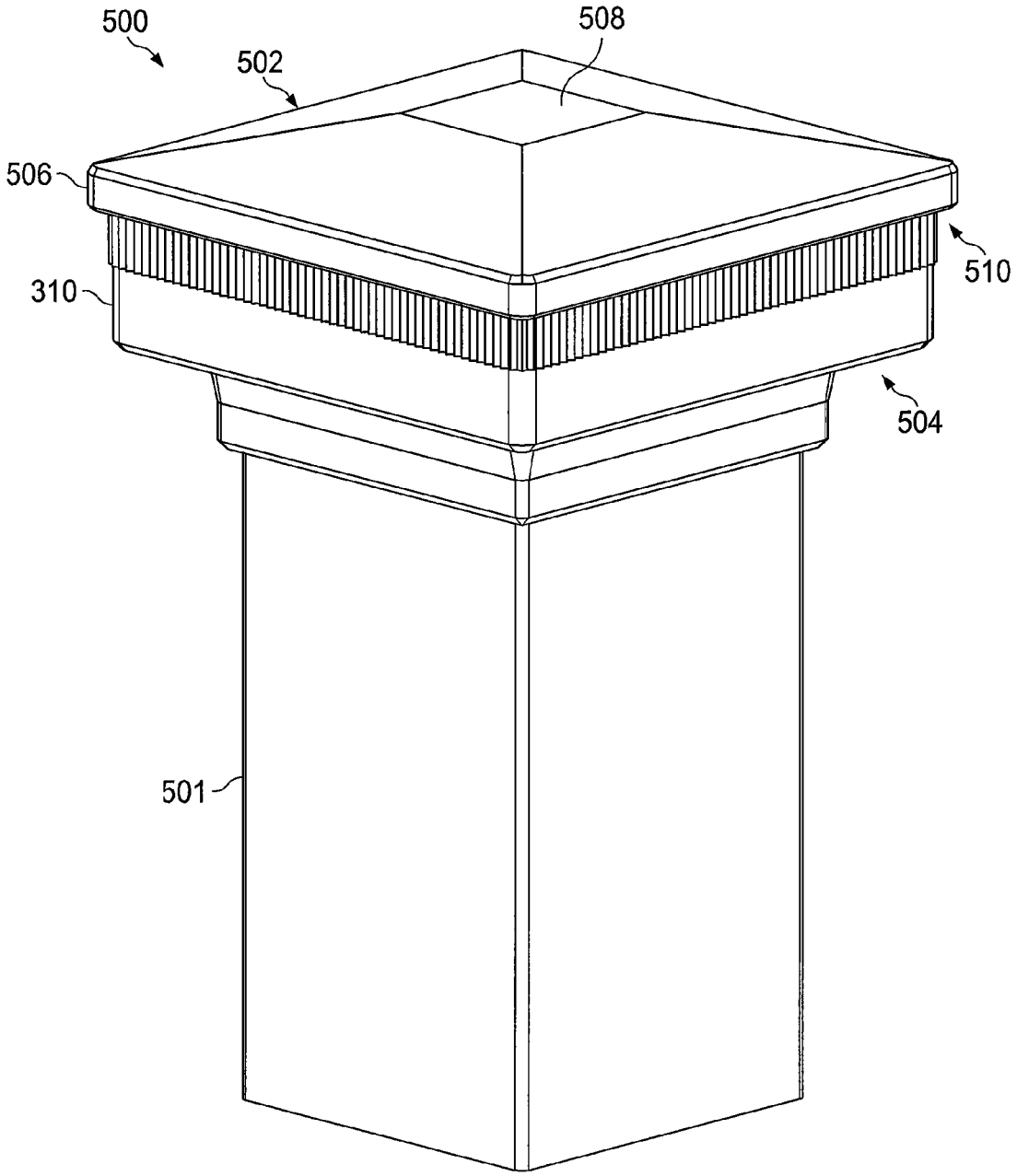
FIG. 21 is a perspective view of a fifth accent lighting source.
Figure 22:
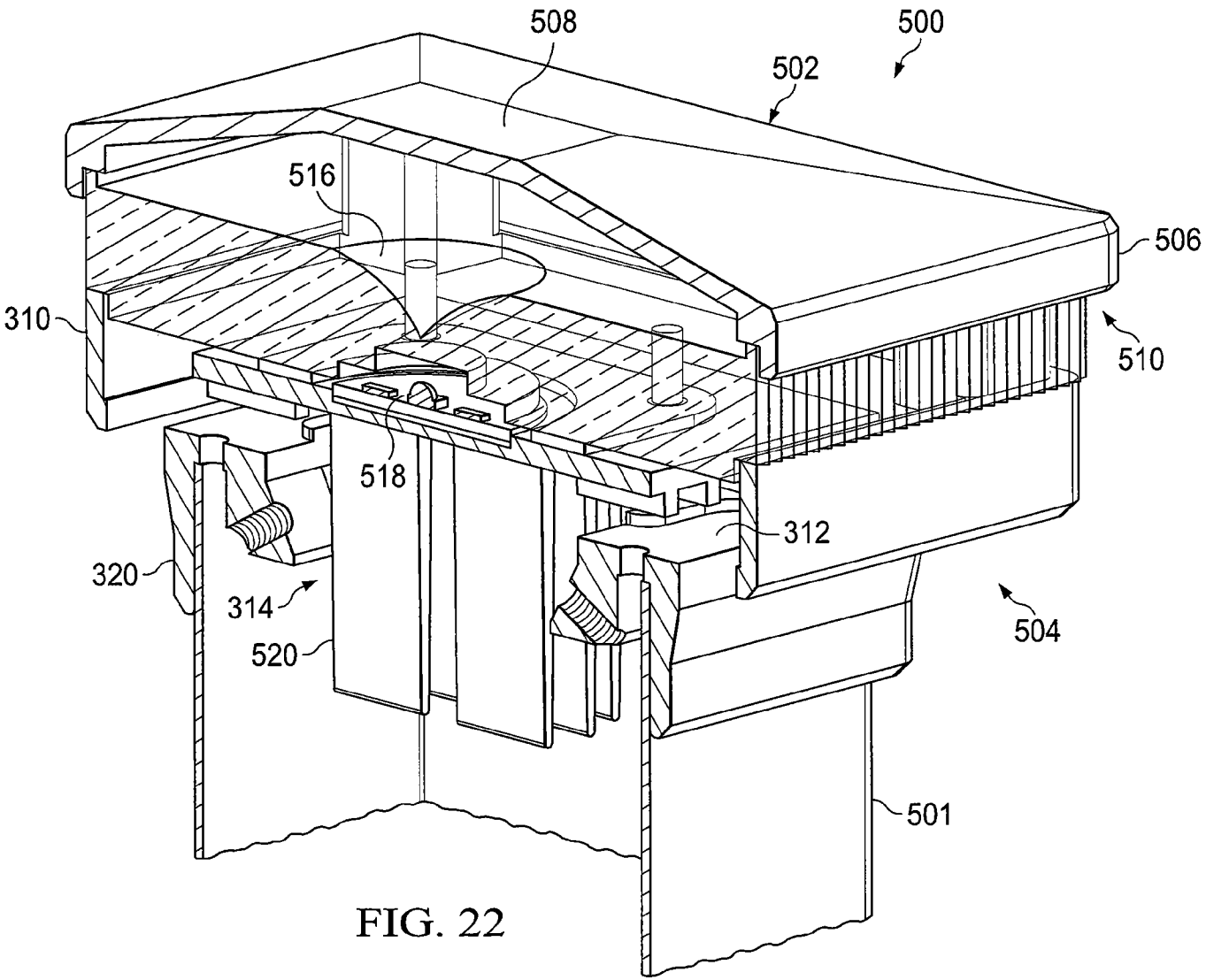
FIG. 22 is a cross-sectional view of the fifth accent lighting source.

Reference is now made to FIG. 21 which shows a perspective view of a fifth accent lighting source 500. FIG. 22 is a cross-sectional view of the fifth accent lighting source 500. The source 500 is a post cap mount type source designed for installation at the top of a post member 501. The source comprises a cover 502 (see, also, previous comments concerning the configuration of cover 308 in FIG. 8). The cover includes side walls 506 and a roof 508, with the roof 508 having a truncated pyramidal shape. The source further comprises a base plate 504. The base plate 504 has a similar configuration to that shown in FIGS. 12-13 (see discussion above for details) and includes first side walls 310, floor 312, central opening 314, and second side walls 320.

Figure 23A:
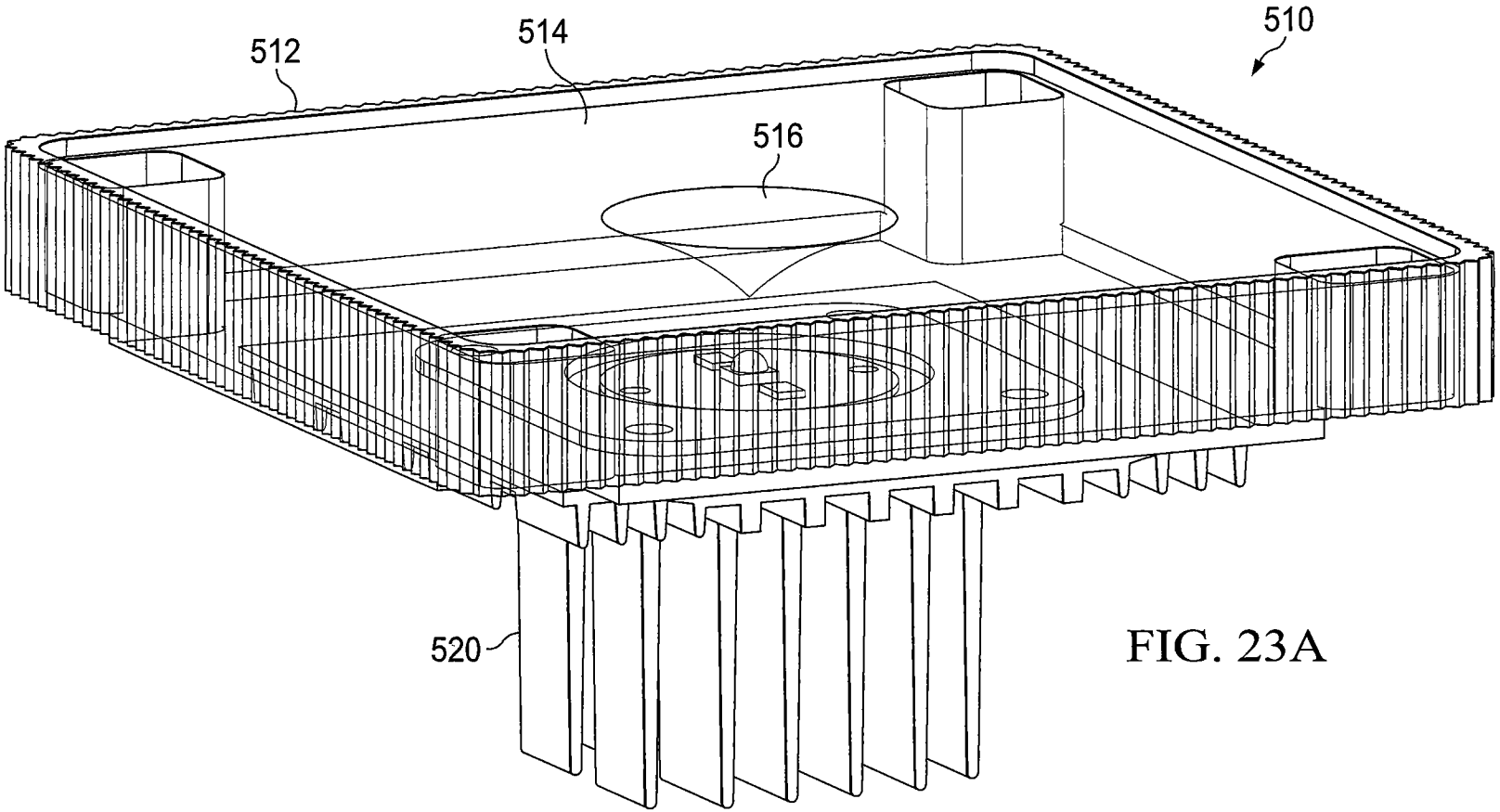
FIGS. 23A and 23B are perspective views of a glow ring assembly used within the fifth accent lighting source
Figure 23B:
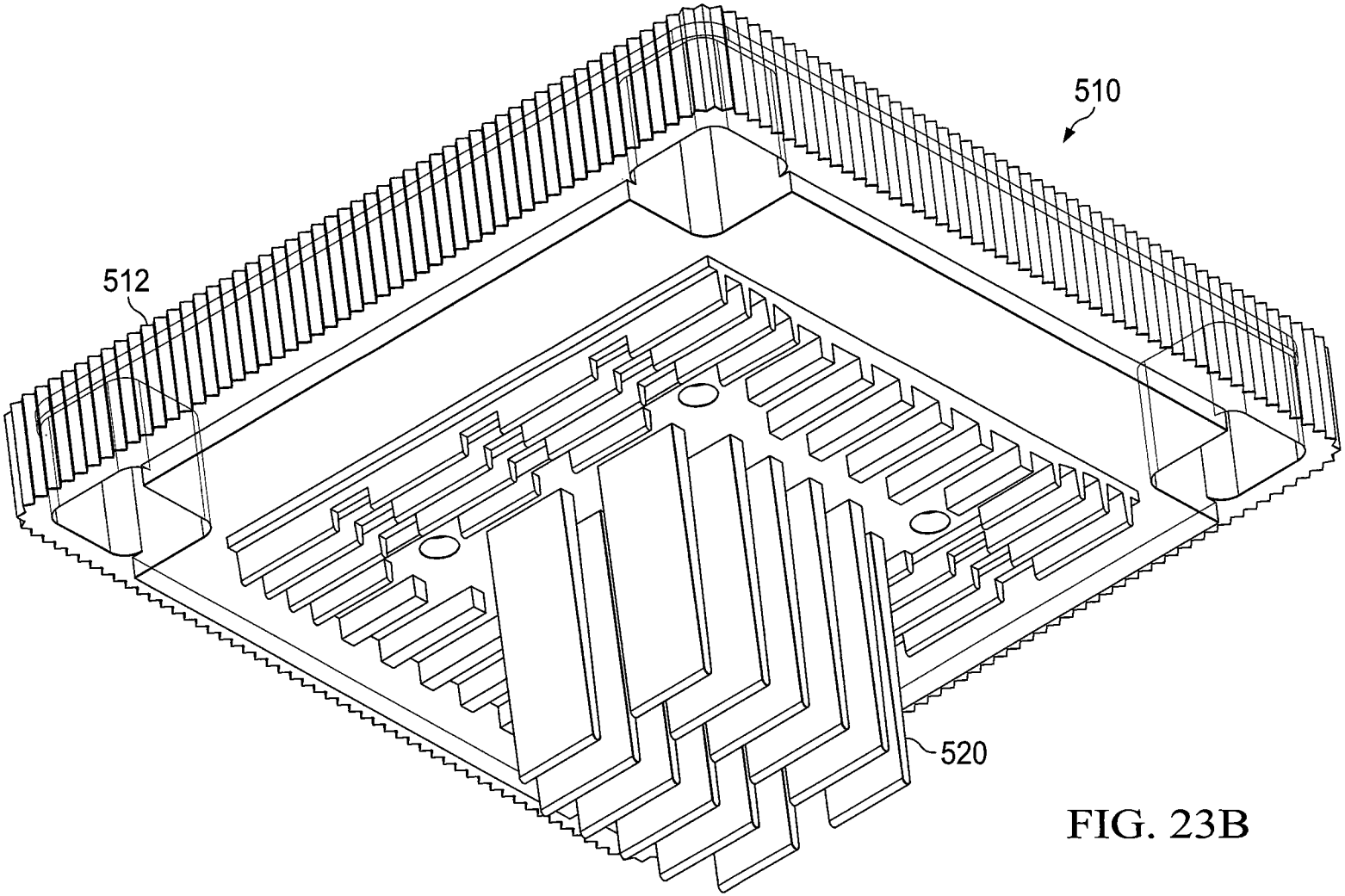
Figure 24:
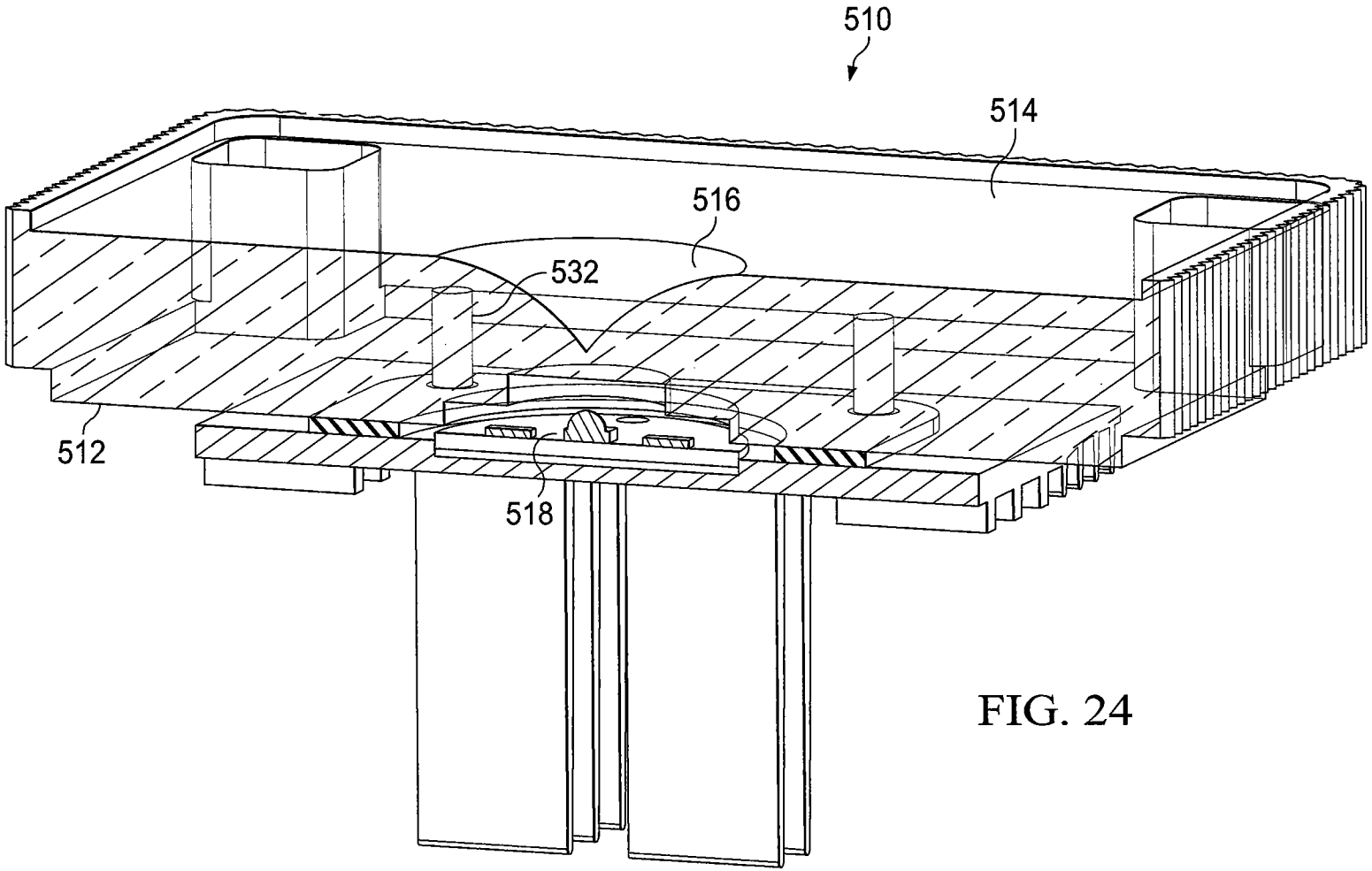
FIG. 24 is a cross-sectional view of the glow ring assembly.
Figure 25:
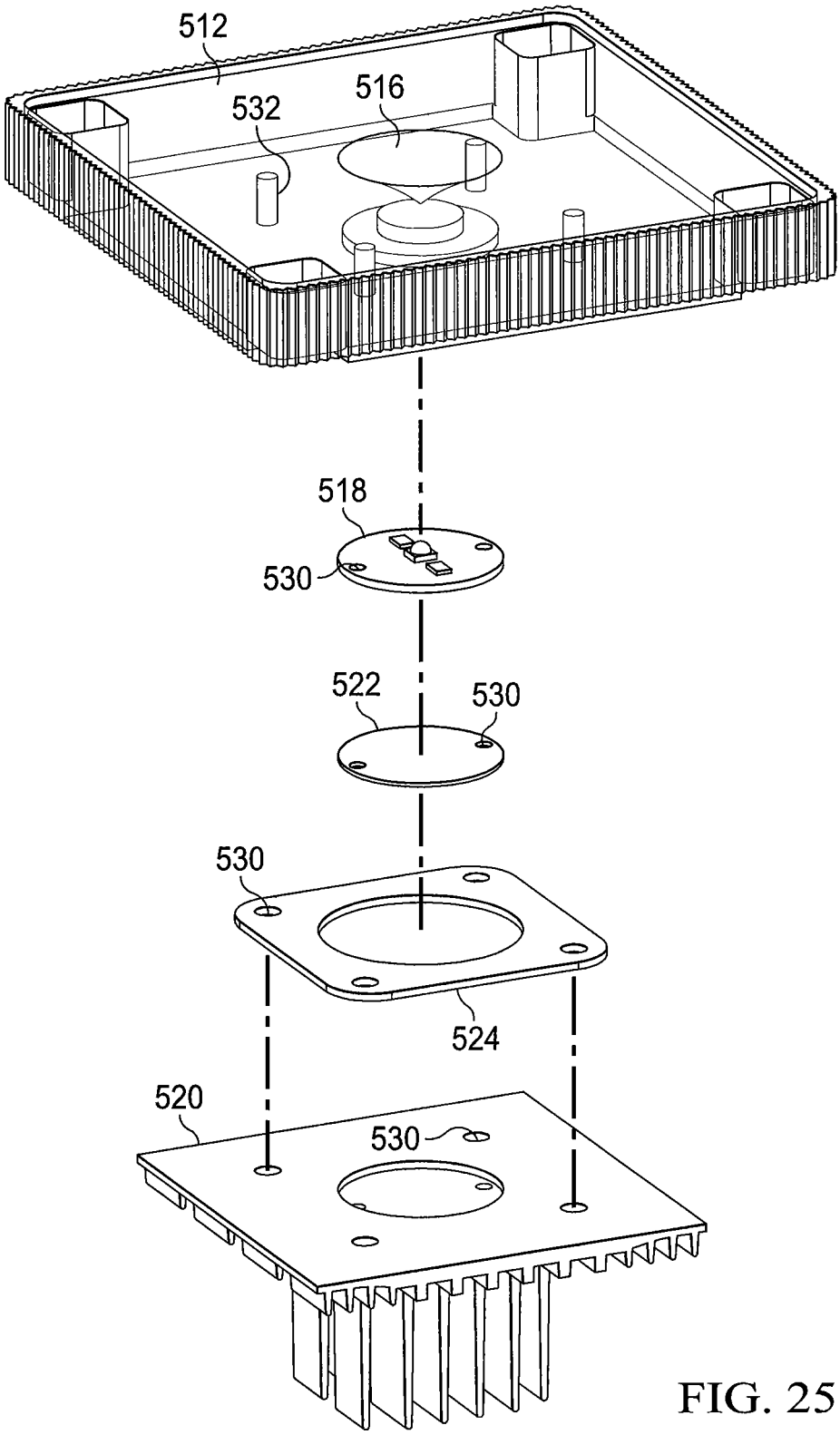
FIG. 25 is an exploded perspective view of the glow ring assembly.

Sandwiched between the cover 502 and the base plate 504 is a glow ring assembly 510. FIGS. 23A and 23B show perspective views of the glow ring assembly 510. Specifically, FIG. 23A shows a top perspective view of the glow ring assembly 510, while FIG. 23B shows a bottom perspective view of the glow ring assembly 510. FIG. 24 shows a cross-sectional view of the glow ring assembly 510. FIG. 25 is an exploded perspective view of the glow ring assembly.

The glow ring assembly 510 includes a transparent or translucent member 512 having a size and shape conforming to the perimeter sizes and shapes of the cover 502 and the base plate 504. The peripheral side surface of the member 512 optionally includes a plurality of vertically extending ridges. A top surface 514 of the member 512 includes, at a central location, a depressed region 516. The depressed region 516 has a curved funnel shape.

Mounted to a bottom surface of the member 512 is a light source 518. The light source 518 is positioned generally at the center of the member 512 in alignment with the location on the top surface of the depressed region 516. A recessed region may be provided in the bottom surface of the member 512 to support mounting and alignment of the light source 518. The light source 518 is oriented to emit light into the member 512 in the direction of the depressed region 516, with the emitted light reflected (through total internal reflection properties) by the depressed region 516 to project radially outwardly therefrom towards the peripheral side surface of the member 512 (if present, the light will be further refracted by the plurality of vertically extending ridges).

The glow ring assembly 510 further includes a heat sink member 520. The heat sink member is metal and is designed to include a plurality of heat sink fins for dissipating heat generated by the light source 518. The heat sink member 520 is thermally mounted to the back of the light source 518 via layer 522 of heat transfer material. A gasket 524 is also provided between the heat sink member 520 and the back of the light source 518. Appropriate mounting hardware, such as screws, can be used to assemble the glow ring assembly 510. Openings 530 for passing the mounting hardware are provided in the heat sink member 520, gasket 524 and light source 518. A threaded aperture 532 is formed in the bottom of the member 512 to receive the mounting hardware.

When sandwiched between the cover 502 and the base plate 504, the plurality of heat sink fins of the heat sink member 520 for the glow ring assembly 510 pass through the central opening 314 of the base plate 504. The wiring for the light source 518 also passes through the central opening 314.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A post cap assembly, comprising: a base plate having a floor, an upper peripheral wall extending from the floor in a first direction and a lower peripheral wall extending from the floor in a second direction opposite the first direction, the base plate configured to be secured to a post having a square-shaped cross section; a cover having a pyramidal shape, the cover configured to be coupled to the base plate; wherein the base plate includes at least two tabs each having a through hole configured to receive a fastener for securing the base plate to the post; wherein the base plate includes a plurality of rectangular-shaped through holes extending through the floor of the base plate and disposed proximate the upper peripheral wall of the base plate, each rectangular-shaped through hole configured to receive a light assembly comprising multiple downward projecting point light sources; and the floor further defines a plurality of recesses, each recess disposed proximate a respective rectangular-shaped through hole and configured to align the light assembly with the respective rectangular-shaped through hole.

2. The post cap assembly of claim 1 wherein the tabs each comprise a boss member and the through holes are each configured to receive a set screw.

3. The post cap assembly of claim 2 wherein each boss member includes a slanted face through which the through hole extends.

4. The post cap assembly of claim 1 wherein the cover includes a plurality of bosses configured to be received by the base plate.

5. The post cap assembly of claim 4 wherein the bosses include holes configured to receive a fastener to secure the cover to the base plate.

6. The post cap assembly of claim 1 wherein the plurality of rectangular-shaped through holes comprises at least four rectangular-shaped through holes each disposed proximate one of four wall segments of the upper peripheral wall.

7. The post cap assembly of claim 6 wherein the floor further defines at least four recesses, each recess disposed proximate a respective rectangular-shaped through hole and configured to align the light assembly with the respective rectangular-shaped through hole.

8. The post cap assembly of claim 1 wherein the lower peripheral wall is configured to surround an outer surface of a top end of the post.

9. The post cap assembly of claim 1 wherein the post is hollow and the tabs each comprise a boss member and the through holes are each configured to receive a set screw, and wherein gaps are formed between the boss members and the lower peripheral wall, the gap configured to receive a wall of the hollow post, the set screws securing the base plate to the hollow post.

10. A post cap assembly, comprising: a base plate having a floor, an upper peripheral wall extending from the floor in a first direction and a lower peripheral wall extending from the floor in a second direction opposite the first direction, the base plate configured to be secured to a hollow post having a square-shaped cross section; a cover configured to be coupled to the base plate; wherein the base plate includes at least two boss members each having a slanted face and a through hole configured to receive a set screw, the base plate defining a gap disposed between each boss member and the lower peripheral wall, the gap configured to receive a wall of the hollow post and the set screws securing the base plate to the hollow post; wherein the base plate includes a plurality of rectangular-shaped through holes extending through the floor of the base plate and disposed proximate the upper peripheral wall of the base plate, each rectangular-shaped through hole configured to receive a downward projecting light assembly comprising multiple point light sources; and the floor further defines a plurality of recesses, each recess disposed proximate a respective rectangular-shaped through hole and configured to align the downward protecting light assembly with the respective rectangular-shaped through hole.

11. The post cap assembly of claim 10 wherein the cover includes a plurality of bosses configured to be received by the base plate.

12. The post cap assembly of claim 11 wherein the bosses include holes configured to receive a fastener to secure the cover to the base plate.

13. The post cap assembly of claim 10 wherein the plurality of rectangular-shaped through holes comprises at least four rectangular-shaped through holes each disposed proximate one of four wall segments of the upper peripheral wall.

14. The post cap assembly of claim 13 wherein the floor further defines at least four recesses, each recess disposed proximate a respective rectangular-shaped through hole and configured to align the downward projecting light assembly with the respective rectangular-shaped through hole.

15. A post cap assembly, comprising: a base plate having a floor, an upper peripheral wall extending from the floor in a first direction and a lower peripheral wall extending from the floor in a second direction opposite the first direction, the base plate configured to be secured to a post having a square-shaped cross section; a cover configured to be coupled to the base plate; wherein the base plate includes at least two tabs each having a through hole configured to receive a fastener; wherein the base plate includes at least four rectangular-shaped through holes each disposed proximate one of four wall segments of the upper peripheral wall, each rectangular-shaped through hole configured to receive a downward projecting light assembly comprising multiple point light sources; and wherein the floor further defines at least four recesses, each recess disposed proximate a respective rectangular-shaped through hole and configured to align the downward projecting light assembly with the respective rectangular-shaped through hole.

16. The post cap assembly of claim 15 wherein the cover includes a plurality of bosses configured to be received by the base plate.

17. The post cap assembly of claim 16 wherein the bosses include holes configured to receive a fastener to secure the cover to the base plate.

18. The post cap assembly of claim 15 wherein a shape of the cover is selected from the group consisting of: dome-shaped, pyramid-shaped, and flat.

* * * * *